US005564340A

United States Patent [19]

Baird et al.

[11] Patent Number: 5,564,340

[45] Date of Patent: Oct. 15, 1996

[54] COKE OVEN RAIL CAR WITH DRIVE CONTROL SYSTEM FOR POSITIONING THE CAR AND DOOR EXTRACTOR WHICH COMPENSATES FOR THERMAL DISTORTION OF OVEN JAMBS

[75] Inventors: Billy C. Baird, Sturgis, Ky.; Robert H. Higginson, Evansville, Ind.; Roger A. Kares, Sturgis, Ky.

[73] Assignee: Saturn Machine & Welding Co., Inc., Sturgis, Ky.

[21] Appl. No.: 175,291

[22] Filed: Dec. 29, 1993

Related U.S. Application Data

[63] Continuation-in-part of Ser. No. 56,113, Apr. 30, 1993, Pat. No. 5,447,106.

[51] Int. Cl.[6] ..... B60L 15/00

[52] U.S. Cl. ..... 104/295; 104/154; 105/130; 105/355; 246/167 R; 414/147; 414/188; 414/198; 414/352; 414/541; 414/584; 414/684.3; 74/128; 74/160; 202/227; 202/262

[58] Field of Search ..... 104/154, 295; 105/32, 96.1, 128, 130, 355; 414/147, 160, 172, 188, 198, 273, 352, 396, 401, 469, 495, 541, 584, 661, 663, 684.3; 192/85 AA; 74/128, 160; 202/227, 262; 110/176, 177

[56] References Cited

U.S. PATENT DOCUMENTS

| | | | |
|---|---|---|---|
| 2,746,610 | 5/1956 | Henseleit | 414/684.3 |
| 2,797,795 | 7/1957 | West | 74/128 |
| 2,797,820 | 7/1957 | Homan | 414/684.3 |
| 3,300,697 | 1/1967 | Woodford | 74/128 |
| 3,784,034 | 1/1974 | Thompson | 414/188 |
| 4,248,562 | 2/1981 | Tsuzuki et al. | 414/584 |
| 4,372,819 | 2/1983 | Irwin | 202/262 |
| 4,415,975 | 11/1983 | Burt | 414/273 |
| 4,494,905 | 1/1985 | Yamaji et al. | 414/584 |
| 4,597,709 | 7/1986 | Yonezawa | 414/401 |

FOREIGN PATENT DOCUMENTS

| | | | |
|---|---|---|---|
| 114503 | 1/1942 | Australia | 202/227 |

*Primary Examiner*—S. Joseph Morano
*Attorney, Agent, or Firm*—Wood, Herron & Evans

[57] ABSTRACT

A coke oven door extractor is mounted on the rail car and includes door engaging supports movable in individually differing amounts relative to a plane parallel to and including the door jamb and a door jamb height axis of symmetry and movable vertically, allowing the door extractor to compensate for front-to-back tilting and side-to-side leaning of the coke oven door jamb due to thermal distortion of the battery and variations in individual door heights. The extractor includes a first frame pivotally mounted to the car, a second frame horizontally translatably mounted to the first frame, and a third frame vertically translatably and pivotally mounted to the second frame, with the third frame including the door supports.

40 Claims, 21 Drawing Sheets

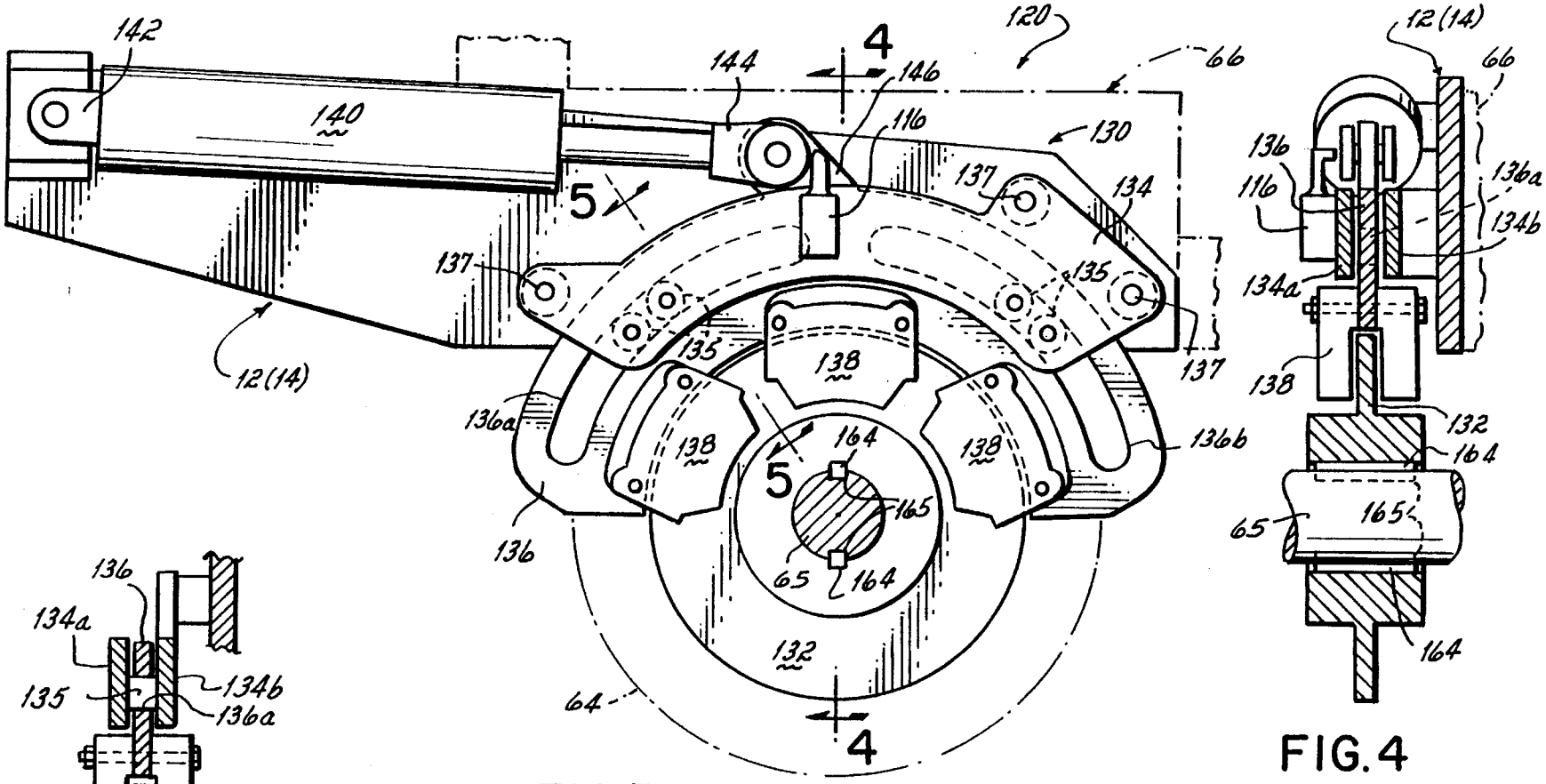
FIG. 4
FIG. 3
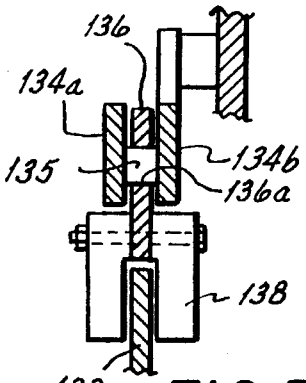
FIG. 5

70
249a
203
226
300
71a
400
200
249b
500
71a 70
303
200
300
202
402
400
502
500
404
230
226
229
203
301
302
403
401
201
501
304
241
240
204

200
300
302
402
202
400
303
301
502
401
404
304
204
203
403
201
500
501
70

COKE OVEN RAIL CAR WITH DRIVE CONTROL SYSTEM FOR POSITIONING THE CAR AND DOOR EXTRACTOR WHICH COMPENSATES FOR THERMAL DISTORTION OF OVEN JAMBS

RELATED APPLICATIONS

This application is a continuation-in-part of application Ser. No. 08/056,113 filed Apr. 30, 1993, now U.S. Pat. No. 5,447,106.

FIELD OF THE INVENTION

This invention relates generally to rail cars, and more particularly to a rail car known as a pusher machine or door machine used at the site of a coke oven battery including a plurality of coke ovens. More particularly, the invention relates to a drive control system for positioning the coke oven pusher machine or door machine relative to a selected oven in the battery or other machinery in other environments that require positioning, and to a door extractor for mounting on a coke oven rail car which compensates for thermal distortion of coke oven batteries and jambs and for relative position differences between ovens in a battery.

BACKGROUND OF THE INVENTION

A coke plant which manufacturers coke from coal for subsequent use in blast furnaces or foundries for making iron therefrom employs one or more coke oven batteries. A coke oven battery is a bank of coke ovens positioned side by side. A coke oven battery can contain a fairly substantial number of coke ovens, spanning a length of several hundred feet.

One side of the coke oven battery is known as the "pusher" side, while the opposite side of the coke oven battery is known as the "door" or "coke" side. On the pusher side, there is a set of railroad type rails or tracks running the length of the battery. Along this set of rails or tracks there rides what is known as a "pusher side machine" or simply "pusher machine". This pusher machine can weigh on the order of 60 to 220 tons, and carries a variety of equipment which is used in conjunction with the coke oven battery. The pusher machine normally incorporates a number of pieces of functional equipment for use in servicing the ovens, including a door extractor for removing and reattaching an oven door to its oven, a door cleaner for cleaning foreign material from the oven door, an oven jamb cleaner for cleaning foreign material from the oven jamb, a pusher ram for pushing the coke through the oven and out the opposite door, and a leveler for insertion through a separate leveler door at the upper end of the coke oven door for levelling the coal loaded from above into the oven.

The opposite side of the coke oven battery, known as the "door side" "coke side" or "back side" similarly includes a set of rails or tracks, with a somewhat smaller "coke side machine" or simply "coke machine" or "door machine" that rolls therealong. This door machine can weigh on the order of 40 to 110 tons. The door machine similarly includes a door extractor, a door cleaner and a jamb cleaner, but includes no pusher ram or leveler. The door machine includes a coke guide which is a rectangularly cross-sectioned chute used for directing the coke from the coke oven over and across the set of rails or tracks and into one or more rail cargo cars known as "hot cars".

In order to utilize the various pieces of equipment on either the pusher machine or door machine in conjunction with a selected oven, the piece of equipment carried by the machine must be aligned with the vertical centerline axis of symmetry of the selected oven which is to be serviced. Positioning the equipment carried by the machine so that its vertical centerline axis of symmetry is aligned with that of the selected oven is known as placing the machine or equipment "on spot".

Some coke plants still use the visual method whereby the operator looks across a sight in the cab to line up on a mark on a buckstay or other structure. Others use a hydraulic cylinder mounted on the door or pusher machine with a receptacle mounted on buckstays or other structures and the operator extends the cylinder shaft into the receptacle having a limit switch to signal success. Some coke plants have tried laser spotting systems but not very successfully. The laser fires a beam to a mark on a buckstay.

Another type of completely manual system for placing the functional equipment of the machine "on spot" has been developed and marketed by the assignee of the present invention. In that spotting system, the pusher or door machine has installed on the top thereof a sprocket driven 500 count encoder/pulse generator having a high speed count/pulse module. An encoder chain is mounted from the face of the battery, e.g. the hot rail outriggers to span the length of the coke oven battery, and is positioned to mesh with the sprocket driven encoder as the machine travels along the tracks. This system further includes a programmable logic controller having a minimum of 6 K of memory, 16 bits of discrete inputs, 16 bits of discrete outputs, a chassis, a power supply for the chassis, a Panelview display monitor for operator input and display output, and a limit switch for resetting the encoder at the zero location all purchased from Allen Bradley. Of course other suppliers could supply equivalent equipment. As the machine travels down the tracks, the encoder sprocket is driven by the encoder chain. The computer is programmed with the position along the chain corresponding to the position of the centerline axis of each oven; therefore for a particular position of the machine along the chain and hence tracks the computer knows the distance between the machine, and hence the functional equipment carried by the machine, and the centerline of any selected oven. Consequently, via the Panelview display, the computer will indicate to an operator the direction in which the machine must travel in order to align the selected piece of equipment carried by the machine with the selected oven. The operator energizes the travel controller by pushing the appropriate button or otherwise activating the appropriate control on the Panelview display to move the machine in one direction along the rails, or reverses the travel controller to move the machine in the other direction along the rails. The Panelview display continues to indicate the direction in which the car is required to be moved to align the piece of equipment with the selected oven. When the machine gets near the selected oven the operator slows the machine, and then gradually moves the machine on spot using the manually operated travel controller. Should the operator cause the machine to overshoot the on spot position, the Panelview display simply indicates that the machine must then be moved in the opposite direction. The operator so jogs or jockeys the machine back and forth using the manual travel controller until the Panelview display indicates the precise on spot position.

The resolution of the sprocket driven encoder in combination with the chain is on the order of plus or minus 0.025 inch. However, due to the limitations of a human operator's manual dexterity in operating the travel controller, an operator is normally only able to position or spot the machine and its associated equipment within plus or minus ½" of the true on spot position. Consequently, via this manual type of spotting, an operator is unable to exploit the resolution of the encoder as he is normally off of true on spot by plus or minus ½". By being off by as much as plus or minus ½" the equipment carried by the pusher machine and door machine can be damaged, and can damage the coke oven door and the door jamb. For example, when replacing a door that has been extracted from its oven, a variation of plus or minus ½" from true on spot can greatly damage the seal of the coke oven door and/or the jamb of the coke oven itself. This damage results in downtime of the oven and costly repair is required to repair the door jamb and/or door seal. Similarly, if the jamb cleaner is off by as much as plus or minus ½" it likewise can become damaged and/or damage the door jamb. The same is true if the pusher ram is off by as much as plus or minus ½".

Damage also results to the coke oven door jamb and the coke oven door and seal due to the fact that the traditional door extractor which removes and replaces a coke oven door from and into its respective coke oven jamb cannot compensate for thermal distortion of the coke oven battery and consequential distortion of the plane of the coke oven door jamb. More particularly, the heat generated by the coke oven battery causes the upper portion of the battery to expand. When viewed from the side, the battery assumes a "V" shape, in that the plane of the door jambs on both the pusher and coke sides of the oven tilt outwardly at the top. In some instances, the top part of the jamb will project outwardly as much as 8 inches further than the bottom portion of the jamb. Similarly, when viewed from the front or back, the battery likewise assumes a "V" shape, in that the coke oven battery expands outwardly side-to-side on its ends at the top. Thus, a selected coke oven door jamb and its corresponding door may be leaning either to the left, or to the right, as viewed when facing the oven door, due to whether the particular oven is left or right of the centerline of the battery.

Such thermal distortion of the coke oven battery results in damage to doors and jambs since current door extractors do not have the capability to match the orientation of the oven jamb, and hence the door, as the oven jamb's orientation, and hence door's orientation, changes due to battery thermal expansion. More particularly, these traditional prior art door extractors have no ability to actively tilt from front-to-back to compensate for front-to-back tilting of the jamb. While in some prior art door extractors the extractor is spring mounted and will passively accommodate for some front-to-back tilting of the oven jamb, the pressure needed to overcome the spring force often is sufficient to damage the coke oven door seal.

In other prior art door extractors, while the extractor has the capability of being leaned to compensate for side-to-side leaning of the jamb, such leaning is accomplished manually. Thus, without some means of automatically controlling the lean adjustment, such adjustment has been somewhat tedious and time consuming.

Further, variations in door height have heretofore presented problems for prior art door extractors when trying to match the individual heights of each of the doors. Coke build up on the hearth plate causes such variation in door height since the door rests atop the coke laden hearth plate. The prior art door extractors, utilizing pure rotation of a door extractor arm to engage the door, are inherently inaccurate when trying to match the vertical position of the door since the point at which the arcing extractor arm contacts the door is a function of the distance between the door and door extractor, which varies because of several causes. Deviation in the vertical position of individual ovens also creates vertical positioning problems for prior art door extractors. And, variation in the vertical distance between the tracks on which the machine rides and the ovens creates differences in the relative vertical position between the extractor and individual doors.

Thus, current prior art coke oven door extractors damage coke oven doors and door seals in several ways. Because the coke oven battery and hence coke oven expansion is tilting the door forward at its upper end, the extractor, unable to compensate for this forward tilting, puts undue pressure on the top door section as it removes and reinstails the doors, thus causing seal damage. And with a door jamb and hence door which leans to one side, previous prior art door extractors lacking a lean adjustment damage the refractory plug components mounted to the backs of the doors as well as the door seals because the door extractor can only orient the door vertically, and cannot lean the door in the precise desired amount in a side-to-side direction to align the height centerline axis of the door with the height centerline axis of the oven jamb. In prior art extractors having a lean adjustment, such adjustment, being manual, is tedious and time consuming. And the lack of uniformity in relative position between a door extractor and the individual battery ovens can cause seal and door damage by prior art extractors unable to compensate for varying heights of ovens.

SUMMARY OF THE INVENTION

It has been a main objective of the present invention to more completely utilize and take advantage of the linear resolution of the sprocket driven chain and encoder linear position sensing systems employed with pusher and door side machines and coke oven batteries in order to more accurately position the functional equipment carried by the pusher and coke or door side machines with respect to a selected oven.

It has been another objective of the present invention to reduce the amount of damage inflicted upon coke oven doors and door seals, coke oven jambs, coke oven jamb cleaners, etc., by devising a device which more accurately places these functional components "on spot" relative to a selected oven.

In accordance with the stated objectives, the present invention provides a coke oven rail car with a drive control system for positioning the car and for spotting the functional equipment carried by the car. The car is adapted to roll on rails adjacent to and along the length of the coke oven battery which includes a plurality of coke ovens. A sensor determines the relative position of the car with respect to a selected oven in the battery. The car includes a first drive for effecting gross movement of the car along the rails and gross positioning of the car relative to the selected oven on the basis of the first position determined by the sensor of the car relative to the selected oven. The car further includes a second automatically controlled drive for effecting fine movement of the car along the rails and fine positioning of the car relative to the selected oven on the basis of the second position determined by the sensor of the car relative to the selected oven.

In one embodiment of the present invention, in so-called "semi-automatic" mode, the first drive is manually controlled, while in another embodiment, in so-called "fully automatic" mode, the first drive is automatically controlled.

The first manually controlled drive comprises a first drive assembly, a motor for driving the first drive assembly, and a manual operator controller for manually controlling the motor whereby an operator can position the car in a first selected position relative to the selected oven with the first drive assembly. In the other embodiment, the first automatically controlled drive comprises a first drive assembly, a motor for driving the first drive assembly, and a first automatic controller for automatically controlling the motor whereby the car is automatically positioned in the first selected position relative to the selected oven with the first drive assembly.

In both embodiments, the second automatically controlled drive comprises a second drive assembly, an actuator for actuating the second drive assembly, and an automatic controller for automatically controlling the actuator and the second drive assembly whereby the car is automatically positioned in the second selected position relative to the selected oven with the second drive assembly.

The invention contemplates that the second drive assembly comprise either a disk clutch mechanism or a band clutch mechanism for driving a wheel axle of the car, and that the actuator comprise a hydraulic cylinder or hydraulic or electric motor connected between the car and the disk clutch mechanism or the band clutch mechanism.

The disk clutch mechanism can take one of two forms. In one form the mechanism comprises a disk mounted to the wheel axle, a support bracket mounted to the car adjacent the axle, a caliper bracket movably mounted on the support bracket, the caliper bracket being moveable relative to the support bracket about an axis of rotation of the wheel axle, the caliper bracket including at least one caliper for cooperation with the disk, with the automatic controller being operable to clamp and release the caliper to and from the disk and for extending and retracting the hydraulic cylinder.

In the other form of the disk clutch mechanism, the mechanism comprises a disk mounted to the wheel axle, and a caliper bracket mounted to a hub. The hub is movably mounted relative to the wheel axle about an axis of rotation of the wheel axle, and includes at least one caliper for cooperation with the disk, with the automatic controller being operable to clamp and release the at least one caliper to and from the disk and for extending and retracting the hydraulic cylinder.

The band clutch mechanism comprises a drum mounted to the wheel axle, a clutch band encircling the drum, and a band tightening cylinder connected to opposite ends of the band, with the automatic controller being operable to clamp and release the brake band to and from the drum with the band tightening cylinder and for extending and retracting the hydraulic cylinder and/or energizing the hydraulic or electric motor.

The invention further contemplates the utilization of a brake in conjunction with the second automatically controlled drive, with the automatic controller being operable to actuate the brake for decelerating the car and maintaining the car in the second selected position.

A primary advantage of the present invention is that the resolution of the chain driven sprocket encoder, commonly used on pusher and door machines, can more effectively be utilized by fully exploiting its resolution to position a pusher or door car within plus or minus 0.025" of true on spot, rather than the plus or minus ½" attainable when relying only on an operator's manual dexterity and coordination.

Another advantage of the present invention is that savings accrue and downtime is eliminated in that coke oven doors, door seals, jambs and jamb cleaners are not damaged when an oven is attempted to be serviced by the functional equipment when the machine and hence equipment are not completely "on spot".

Yet another object of the present invention has been to provide a coke oven door extractor which can compensate for front-to-back tilting and side-to-side leaning of the coke oven door due to thermal expansion and distortion of a coke oven battery and hence coke oven and its respective jamb.

Still another object of the present invention has been to provide a coke oven door extractor which can compensate for differences in relative vertical position between the door extractor and individual doors in the battery.

In accordance with the stated objectives, the present invention further provides a coke oven door extractor for mounting on a coke oven rail car, the extractor including a pair of door engaging supports for engaging and supporting the door, with the supports being movable in individually differing amounts relative to a plane parallel to and including the door jamb and a door jamb height axis of symmetry, and movable vertically. The supports, being movable in individually differing amounts relative to the aforementioned references, allow the door extractor to compensate for front-to-back tilting and side-to-side leaning of the coke oven door jamb due to thermal distortion of the battery. The supports being movable vertically allow the door extractor to compensate for differences in relative height between individual ovens in the battery.

Preferably the door extractor of the present invention is used in conjunction with a coke oven rail car employing the drive control system of the present invention. Each oven in the bank of coke ovens would be individually measured for its respective door jamb front-to-back tilting and side-to-side leaning, and for the engagement height of the extractor when properly vertically engaging the door. These values would be stored into a memory of an automatic controller. Thus, when the drive control system of the present invention places the car on spot relative to a selected oven, the front-to-back tilting and side-to-side leaning values for that oven jamb would be then recalled from memory, as would the vertical engagement value, and the automatic controller would then automatically control the movement of the supports to align the door extractor with the door jamb, and hence the door.

The door extractor preferably comprises a first frame adapted to be mounted on the coke oven rail car, a second frame movably mounted on the first frame, a third frame which includes the pair of door engaging supports movably mounted on the second frame, means for moving the third frame relative to the second frame to effect movement of the supports in individually differing amounts relative to the plane parallel to and including the door jamb, and means for moving the first frame relative to the car to effect movement of the supports in individually differing amounts relative to the door jamb height axis of symmetry.

The means for moving the third frame relative to the second frame preferably comprises a pivot connection pivotally connecting an upper end of the third frame to the second frame, and a hydraulic cylinder operably connected between a lower end of the third frame and the second frame, such that extending and retracting the cylinder pivots the third frame and hence the door supports relative to the second frame about the pivot connection.

The means for moving the first frame relative to the car preferably comprises a pivot connection pivotally connecting the lower end of the first frame to the car, and a hydraulic cylinder operably connected between an upper end of the first frame and the car, such that extending and retracting the cylinder pivots the first frame and hence the door supports relative to the car about the pivot connection.

The door extractor additionally further comprises means for effecting relative horizontal movement between the first and second frames, and means for effecting relative vertical movement between the second and third frames, such that the second frame and hence the door supports can be extended forwardly to engage the coke oven door and the third frame and hence the door supports can be raised upwardly to remove the door from its door jamb.

Preferably the means for effecting relative horizontal movement between the first and second frames comprises a fourth frame movably mounted on the first frame, means for effecting relative vertical movement between the first and fourth frames, and linkage connecting the fourth and second frames, such that when the relative vertical movement means moves the fourth frame relative to the first frame in one direction the linkage moves the second frame relative to the first frame in one direction, and when the relative vertical movement means moves the fourth frame relative to the first frame in another direction the linkage moves the second frame relative to the first frame in another direction.

The means for effecting relative horizontal movement between the first and second frames preferably further comprises rollers mounted on the second frame, and horizontally oriented channels mounted on the first frame, with the rollers riding in the channels.

The means for effecting relative vertical movement between the first and fourth frames preferably comprises rollers mounted on the fourth frame, vertically oriented channels mounted on the first frame, the rollers riding in the channels, and a hydraulic cylinder connected between the first and fourth frames, such that extending and retracting the cylinder rolls the fourth frame upwardly and downwardly relative to the first frame.

The means for effecting relative vertical movement between the second and third frames preferably comprises rollers mounted on the third frame, slots in the second frame, the rollers riding in the slots, and a hydraulic cylinder connected between the second and third frames, such that extending and retracting the cylinder rolls the third frame upwardly and downwardly relative to the second frame.

The invention further resides in methods of reducing damage inflicted upon a coke oven door jamb and coke oven door, during removal of the door from the jamb and reinstallation of the door onto the jamb, by a coke oven door retractor having a pair of door engaging supports for engaging and supporting a door. One method involves the steps of determining the front-to-back tilting orientation of the door, storing the orientation in a memory, removing the door, recalling the orientation from memory, automatically moving the supports to the orientation and reinstalling the door. Another method involves determining the side-to-side leaning orientation of the door, storing the orientation in memory, removing the door, recalling the orientation from memory, automatically moving the supports to the orientation and reinstalling the door. Yet another method involves determining the vertical orientation of the door, storing in a memory the orientation, removing the door, recalling the vertical orientation, automatically moving the door extractor to the orientation and reinstalling the door.

The primary advantage of this aspect of the present invention is that damage normally inflicted upon a coke oven door jamb, and a coke oven door and its seal, during removal of the door from the jamb and reinstallation of the door onto the jamb, is greatly reduced, as the door extractor has the ability to automatically compensate for front-to-back tilting and side-to-side leaning of the coke oven door jamb due to thermal distortion of the battery, and for height variations of ovens and hence doors, thus properly aligning the door with the door jamb.

These and other objects and advantages of the present invention will become more readily apparent during the following detailed description taken in conjunction with the drawings herein, in which:

BRIEF DESCRIPTION OF THE DRAWINGS

FIG. 3 is a side elevational view of one embodiment of the second automatically controlled drive of the spotting system;

FIG. 4 is a view taken along line 4—4 FIG. 3;

FIG. 5 is a view taken along line 5—5 of FIG. 3;

DETAILED DESCRIPTION OF THE INVENTION

Figure 1:
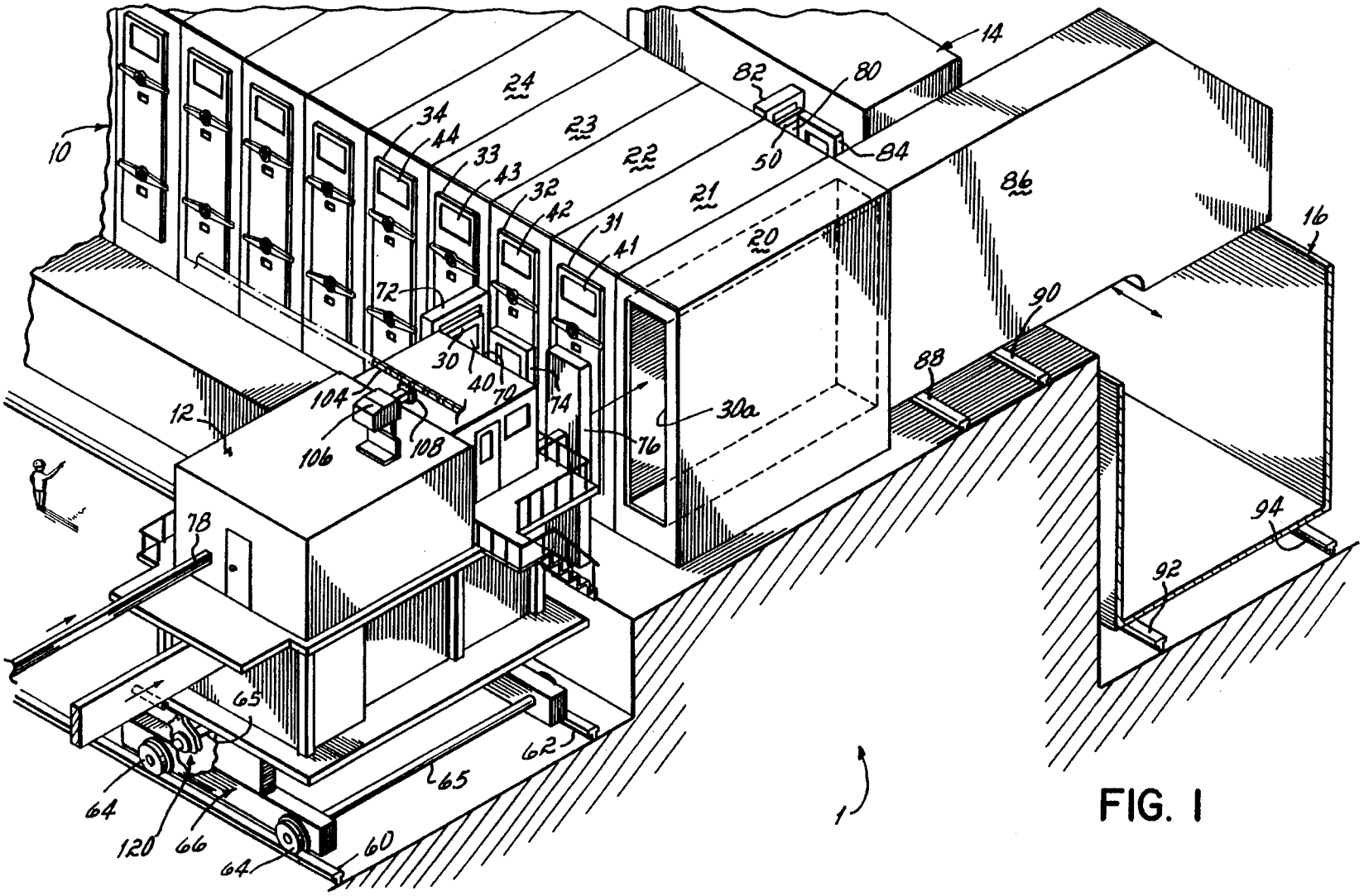
FIG. 1 is a partial perspective view of a portion of a coke plant illustrating coke oven battery, pusher side machine, door or coke side machine and hot car.

With reference first to FIG. 1, there is illustrated a portion of a coke plant 1 which includes, generally, a coke oven battery 10, a pusher side machine 12, a door or coke side machine 14 and a hot car 16.

More particularly, coke oven battery 10 includes a plurality of coke ovens 20–24, each of which includes a respective pusher side oven door 30–34. The pusher side coke oven doors 30–34 include at an uppermost location a small leveler door 40–44. The opposite ends of the coke ovens 20–24 include oven doors similar to those illustrated at 30–34, yet do not include the small upper leveler door. One of the doors on the door or coke side is shown removed from oven 20 and is designated by the numeral 50.

The pusher machine 12 is essentially a large rail car which rolls atop a pair of tracks 60, 62. The car 12 includes rail wheels 64 for riding atop the rails 60, 62. Wheels 64 are mounted to axles 65 which are rotatably supported in pusher machine base support structure 66. The pusher machine 12 incorporates a number of pieces of functional equipment used in servicing the coke oven battery 10. The pusher machine 12 includes a door extractor 70 for removing the door 30 from its respective oven 20, a door cleaner 72 for cleaning the door 30 upon the door extractor 70 rotating the door through approximately 90 degrees from the oven 20 to face the door cleaner 72, and a jamb cleaner 74 for cleaning the jamb 30*a* of oven 20 once door 30 has been removed therefrom. In addition, the pusher machine 12 further includes a pusher ram 76 for pushing the coke all the way through the oven 20 and out the rearward or door side, and a leveler 78 which is inserted through the upper leveler door 40 of door 30 after oven 20 has been charged with coal, for leveling the coal across the top of the oven.

Similarly, the door or coke side machine or door machine 14 likewise includes a door extractor 80 for removing and reattaching door 50 from and to the oven 20, a door cleaner 82 for cleaning the door 80 after removal from the oven 20, and a jamb cleaner 84. The door side machine 14 includes no pusher ram or leveler, but does include a coke guide 86 for directing the coke over the "bench" having tracks 88, 90 thereon upon which the door or coke side machine rolls, and into the hot car 16, which itself rolls on tracks 92, 94.

Figure 2:
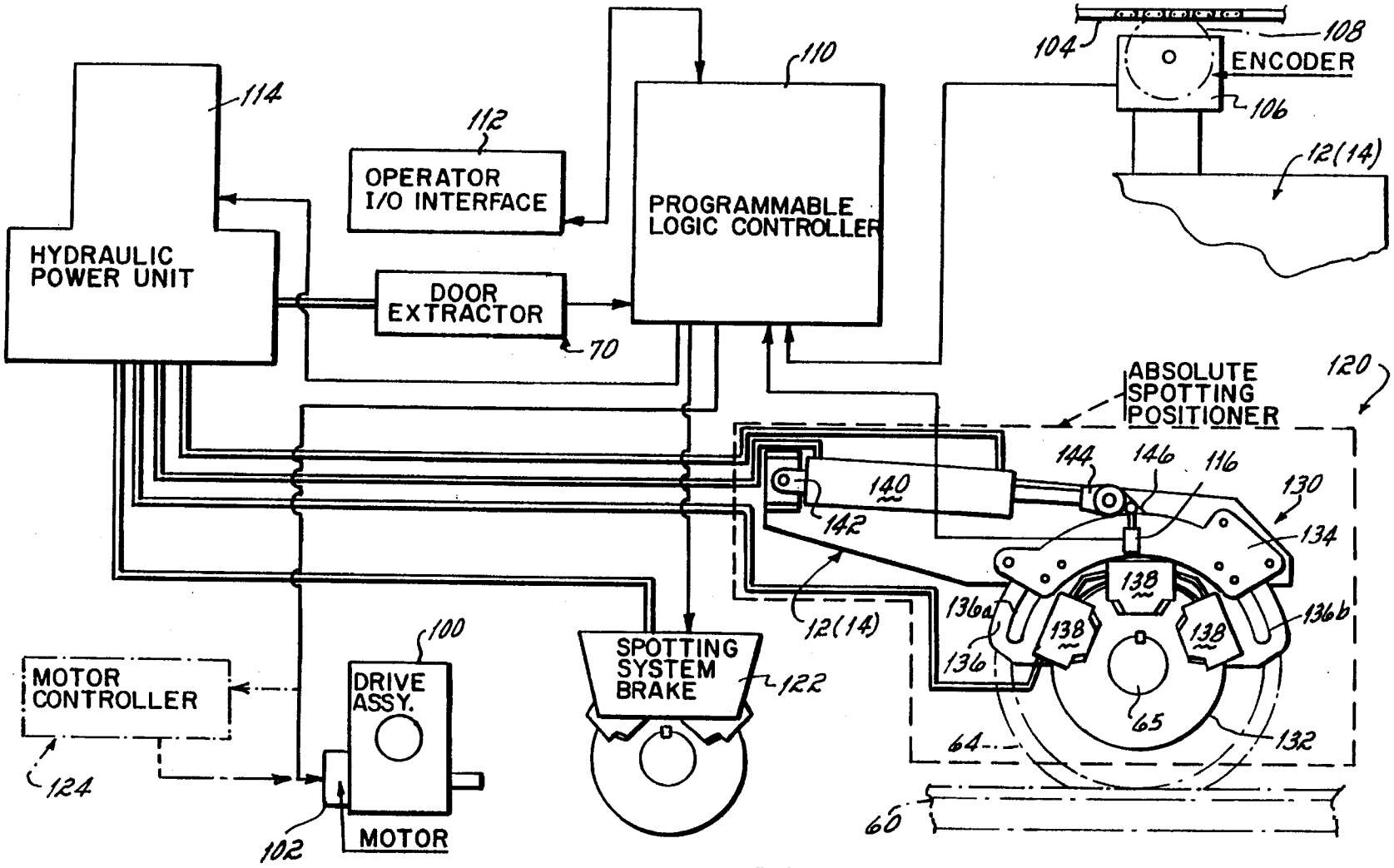
FIG. 2 is a schematic diagram illustrating the components for both the semi-automatic and fully automatic positioning or spotting system of the present invention and door extractor of the present invention.
Figure 6:
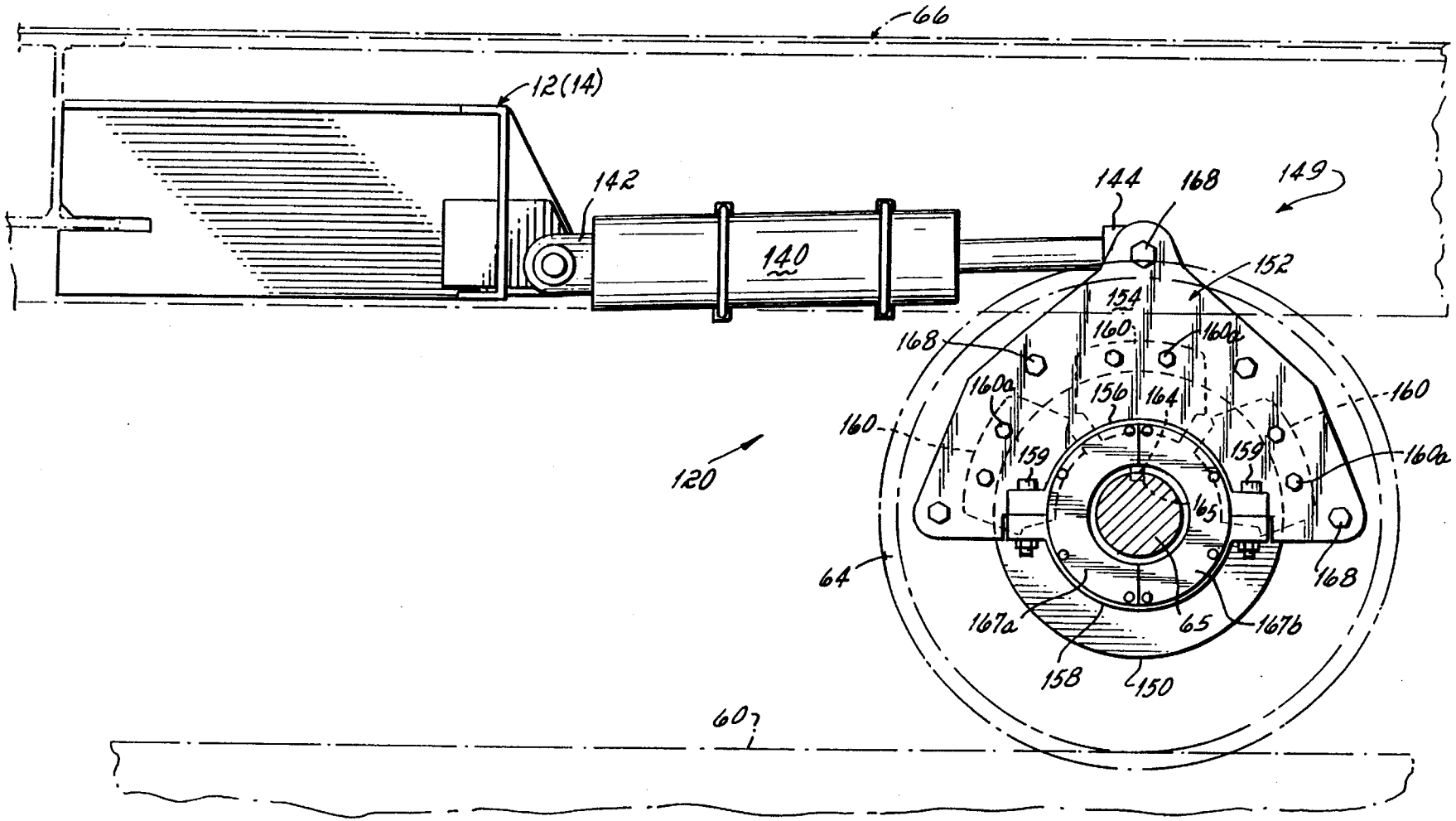
FIG. 6 is a side elevational view of another embodiment of the second automatically controlled drive of the spotting system.
Figure 7:
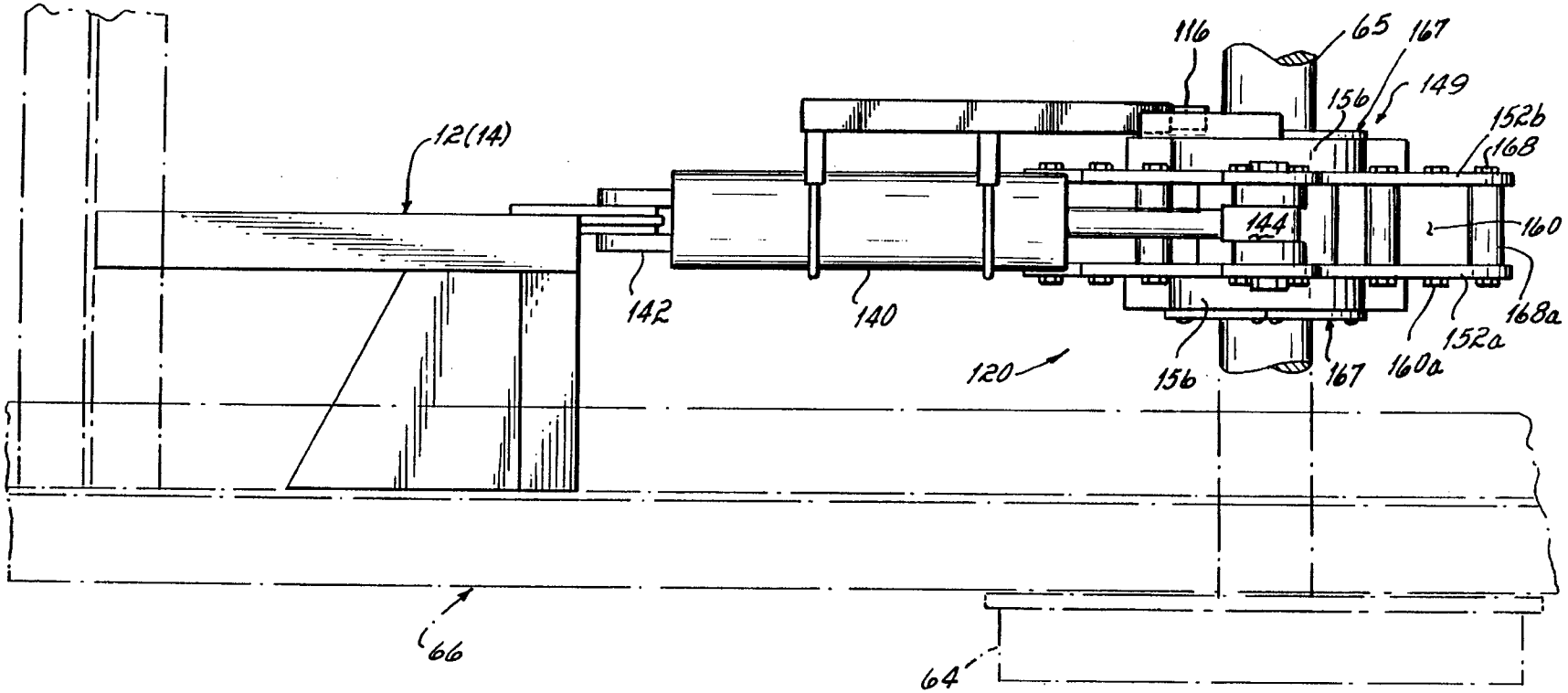
FIG. 7 is a top plan view of the drive of FIG. 6.
Figure 8:
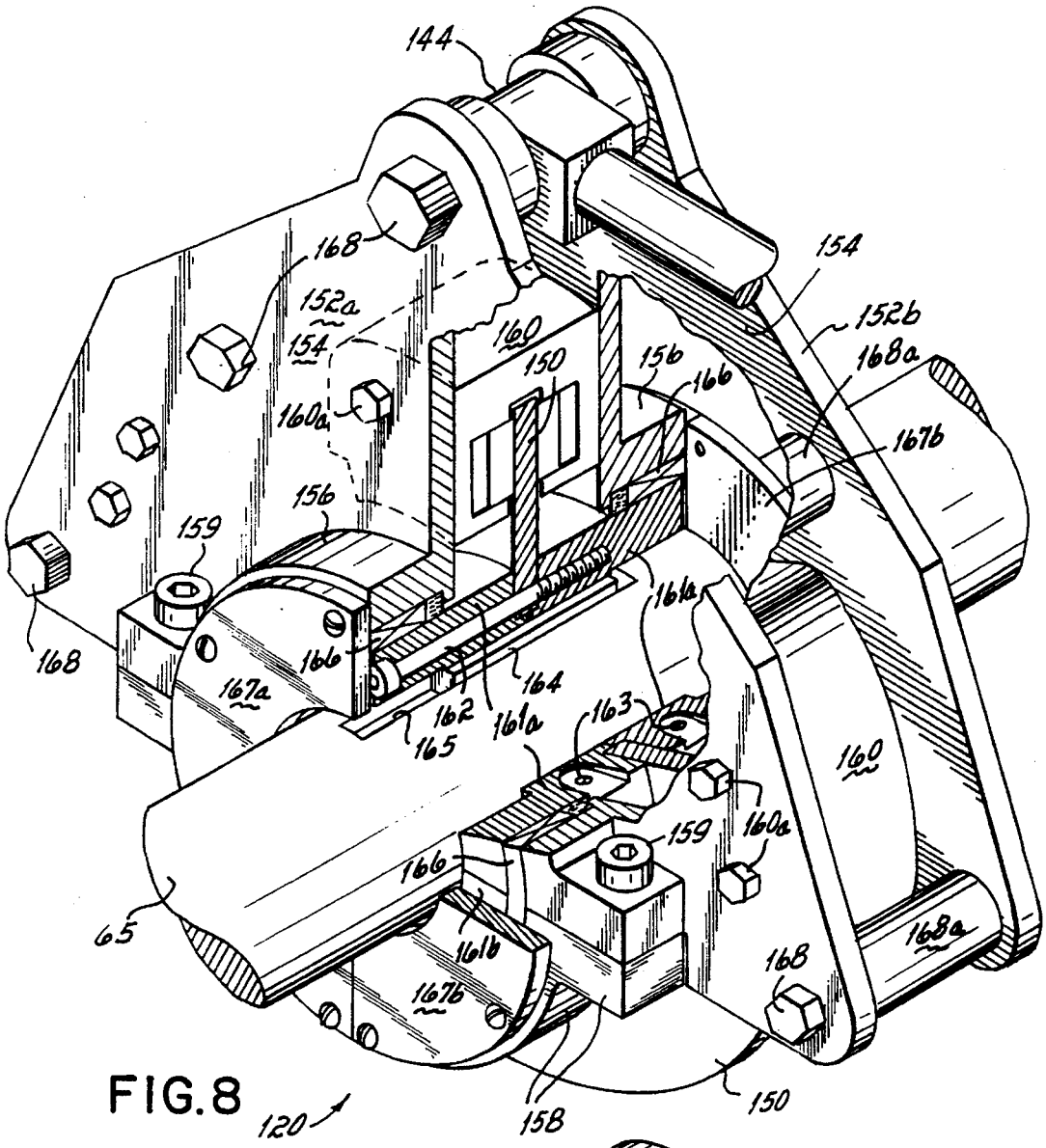
FIG. 8 is a perspective view, partially broken away, of the drive of FIGS. 6 and 7.
Figure 9:
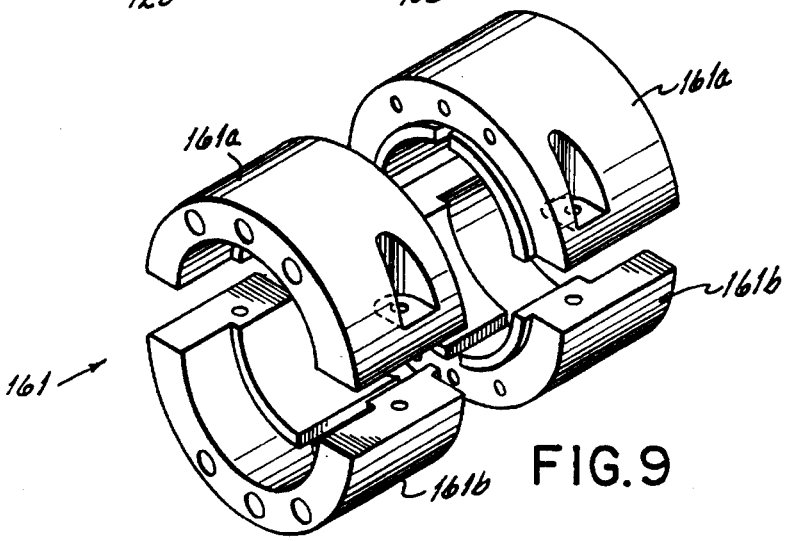
FIG. 9 is an exploded perspective view of a portion of the drive of FIGS. 6–8.

With reference now to FIGS. 1 and 2, the pusher machine 12 is driven along the rails 60, 62 via a first drive comprising a drive assembly 100 and corresponding motor 102. The drive assembly 100 and motor 102 effect rotation of one of the pair of axles 65,65. The drive assembly 100 and motor 102 effect gross movement of the pusher machine 12 along the tracks 60,62 for gross positioning of the car 12 relative to a selected oven in the coke oven battery 10, and as illustrated in FIG. 1, relative to oven 20.

In order to provide gross positioning of the pusher machine 12 relative the selected oven, a chain 104 is strung to span the length of the coke oven battery 10. The chain 104 is preferably mounted to the "hot" (electrically powered) rail outriggers or other suitable structure (not shown, but known to those skilled in the art). There is an encoder 106 mounted to the upper side of the pusher machine 12 which includes an encoder drive sprocket 108 for meshing engagement with the chain 104. Alternatively, one of the axles 65 could be fitted with a sprocket (not shown) and the encoder 106 could then be mounted to the machine 12. A relatively short chain (not shown) would then encircle the axle sprocket and the encoder sprocket 108 with the axle sprocket driving the encoder 106 via the chain.

Referring now to FIG. 2, the encoder 106 sends signals to a programmable logic controller 110, which sends and accepts signals to and from an operator I/O interface 112. The encoder 106 sends a signal to the programmable logic controller 110 of the location of the machine 12; the programmable logic controller 10 determines the direction and distance to be traveled by the machine 12 and displays this information to the operator. Based on the location of the machine 12, the operator I/O interface 112 informs an operator the direction in which the machine 12 is required to be traveled based upon the oven selected for servicing and the functional equipment on the machine 12 to perform the service.

A hydraulic power unit and associated valving 114 accepts signals from the programmable logic controller 110. The hydraulic power unit 114 provides power to a second drive which takes the form of an absolute spotting positioner 120, specific embodiments of which will be subsequently described in more detail. The hydraulic power unit 114 also provides power to a spotting system brake 122, the cooperation of which with the positioner 120 will be subsequently described in more detail.

In the semi-automatic spotting system of the present invention, the programmable logic controller 110 includes a processor having a minimum of 6 K memory, 16 bits of discreet inputs, 16 bits of discreet outputs, a chassis and a power supply for the chassis. The encoder 106 is a 500 count encoder/pulse generator which includes a high speed counter/pulse module. The operator I/O interface 112 is preferably a Panelview monitor display unit or key pad with display. Of course other suppliers could supply equivalent equipment. Additionally, there is a limit switch (not shown) mounted along the length of chain 104 for reset of the spotting operation.

In the fully automatic spotting system of the present invention, the programmable logic controller 110 includes a processor having a minimum 8 K memory, 16 bits of discrete inputs, 24 bits of discrete outputs, a chassis and power supply for the chassis. The encoder 106 is a 500 count encoder/pulse generator with a high speed counter/pulse module. The operator I/O interface 112 is a Panelview display unit, and there is a limit switch (not shown) mounted along the length of the chain 104 for reset of the spotting operation. There is also a motor controller 124 which is added between the programmable logic controller 110 and the motor 102 which drives drive assembly 100.

Describing now the absolute spotting positioner 120, there are three embodiments of this positioner 120 contemplated by the invention. Two embodiments are of the disk clutch variety while the third is of the band clutch variety.

In FIGS. 3–5, one of the disk clutch type mechanisms is illustrated at 130. The mechanism 130 includes a disk 132 fixedly mounted to one of the axles 65 as by key 164 in keyway 165, or other suitable means. A support bracket 134 is mounted to the pusher machine 12 or door machine, and a caliper bracket 136 is movably mounted on the support bracket 134. As best seen in FIGS. 4 and 5, the support bracket 134 includes support bracket halves 134*a* and 134*b* with rollers 135 spanning between the bracket halves 134*a*, 134*b*. Caliper bracket 136 includes a pair of arcuately shaped elongated slots 136*a*, 136*b*. Rollers 135 are positioned in the slots 136*a*, 136*b* allowing the caliper bracket 136 to rotate about the disk 132 and about the wheel 64 axis of rotation. Connected to the caliper bracket 136 are three hydraulic calipers 138, 138, 138 for cooperation with the disk 132. The programmable logic controller 110 controls the hydraulic calipers 138 to clamp and release them to and from the disk 132 by sending appropriate signals to the hydraulic power unit 114.

A hydraulic cylinder 140 has a cylinder end 142 attached to the structure of the door or pusher machine 12 and a piston rod end or simply piston end 144 attached to an upwardly projecting lug 146 of the caliper bracket 136. As with the disk calipers, the programmable logic controller 110 is operable to extend and retract the hydraulic cylinder 140 by sending appropriate signals to the hydraulic power unit 114. The operation of the absolute spotting positioner 120 will be described more fully subsequently during discussion of the flowchart of the program controlled operation of FIG. 11.

Referring now to FIGS. 6–9, the other embodiment of the disk clutch type mechanism of the absolute spotting positioner 120 is illustrated as 149. In this embodiment, and with like numbers representing like components, the mechanism 149 comprises a disk 150 fixedly secured to one of the wheel axles 65. A caliper bracket 152 takes the form of a pair of caliper bracket halves 152*a*, 152*b* each of which includes a plate portion 154 and a semi-circular hub portion 156 fixedly secured to the plate portion 154. There is a lower semicircular hub portion 158 which mates with each of the hub portions 156 and is secured thereto with fasteners 159. Mounted between the plate portions 154, 154 of each of the caliper bracket halves 152*a*, 152*b* are three hydraulic caliper assemblies 160, 160, 160 which cooperate with disk 150 and which are secured to plate portions 154, 154 with fasteners 160*a*. Disk 150 is fixedly secured between two pairs of disk hubs 161, 161, each of the pairs 161, 161 comprising an upper semicircular hub half 161*a* and a lower semicircular hub half 161*b*. Disk 150 is secured between the disk hub pairs 161, 161 via threaded fasteners 162. Additionally, each upper hub half 161*a* is secured to its respective lower hub half 161*b* via fasteners 163. Upper hub halves 161*a*, 161*a* of each of the hub pairs 161, 161 are keyed or otherwise fixedly secured to shaft 65 as by key 164 residing in keyway 165 in shaft 65, or may be fixed in any other conventional manner. A pair of bearings 166, 166 allows the caliper bracket halves 152*a*, 152*b* to rotate relative to the disk 150 and disk hub pairs 161, 161. A pair of semicircular bearing retainer plates 167*a*, 167*b* are secured to hub 152*a* with fasteners 169.

As in the prior disk clutch embodiment, a hydraulic cylinder 140 has its cylinder end 142 connected to the pusher side machine 12 structure, while the piston end 144 of the hydraulic cylinder 140 is connected to a fastener 168 which secures the piston end 144 between the bracket halves 152*a*, 152*b*. Additional fasteners 168 secure stand-offs 168*a* between bracket halves 152*a*, 152*b*. Also as in the prior disk clutch embodiment, the programmable logic controller 110 is operable to clamp and release the hydraulic calipers 160 from the disk 150 and to extend and retract the hydraulic cylinder 140 by sending appropriate signals to the hydraulic power unit 114, the operation of which will be subsequently described in more detail in conjunction with the description of the flowchart of the program controlled operation of FIG. 11.

Figure 10:
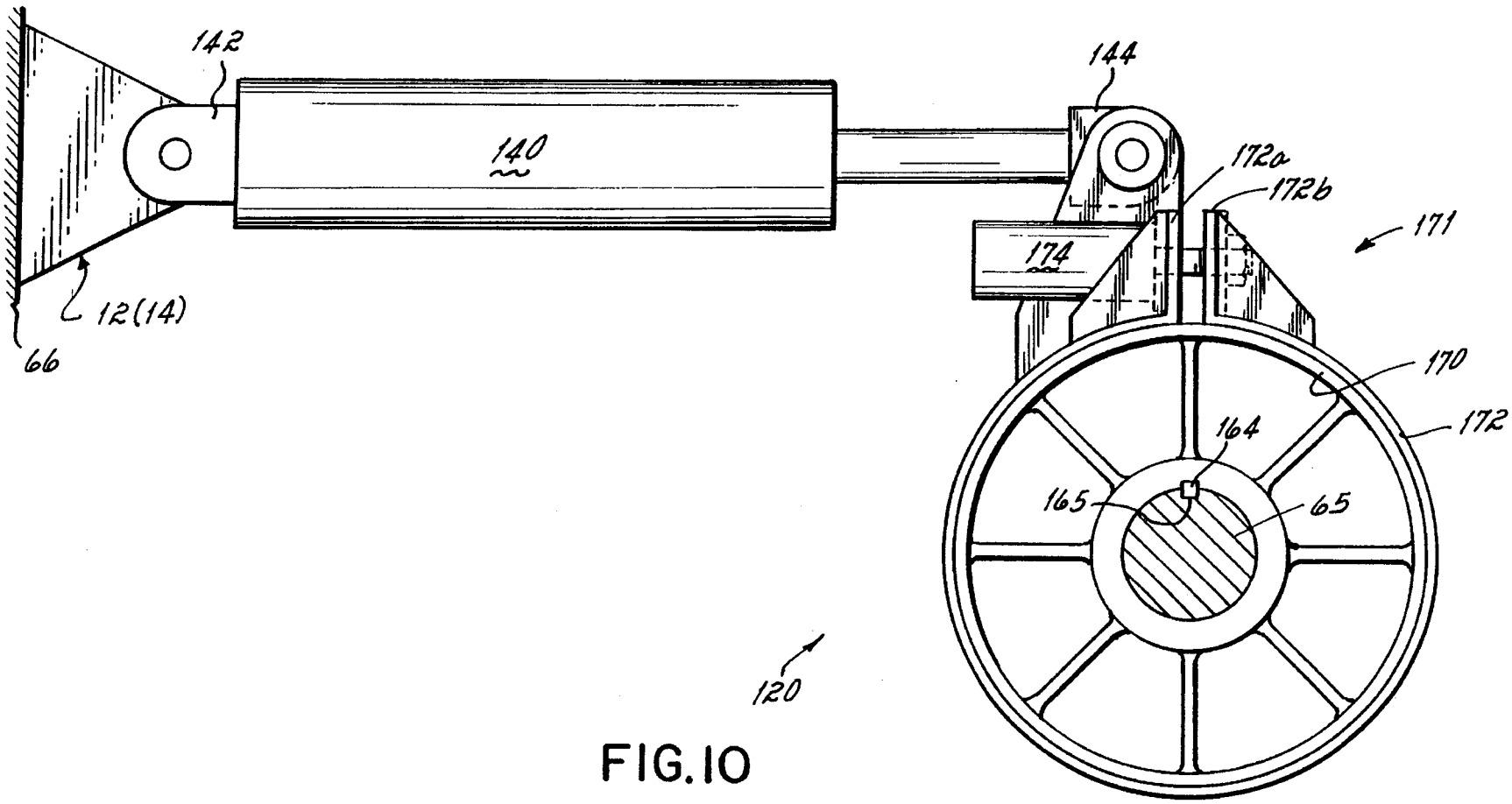
FIG. 10 is a side elevational view of a third embodiment of the second automatically controlled drive of the spotting system.

Referring now to FIG. 10, there is illustrated yet another embodiment of the absolute spotting positioner 120, which takes the form of a band clutch mechanism illustrated at 171. In this embodiment, and again with like numbers designating like components, there is a drum 170 fixedly connected to axle 65 as by key 164 in keyway 165 or other suitable means. Encircling the drum 170 is a band 172 which has opposite end brackets 172*a* and 172*b* connected together with a band tightening hydraulic cylinder 174. As in the prior embodiments, hydraulic cylinder 140 has a cylinder end 142 connected to the pusher machine 12 structure and a piston end 144 connected to band end bracket 172*a*. As in the prior embodiments, the programmable logic controller 110 is operable to clamp and release the band 172 via the band tightening hydraulic cylinder 174 and to extend and retract the hydraulic cylinder 140 by sending appropriate signals to the hydraulic power unit 114 the operation of which will be described subsequently in more detail in conjunction with the flowchart of the programmed controlled operation of FIG. 11.

Figure 11:
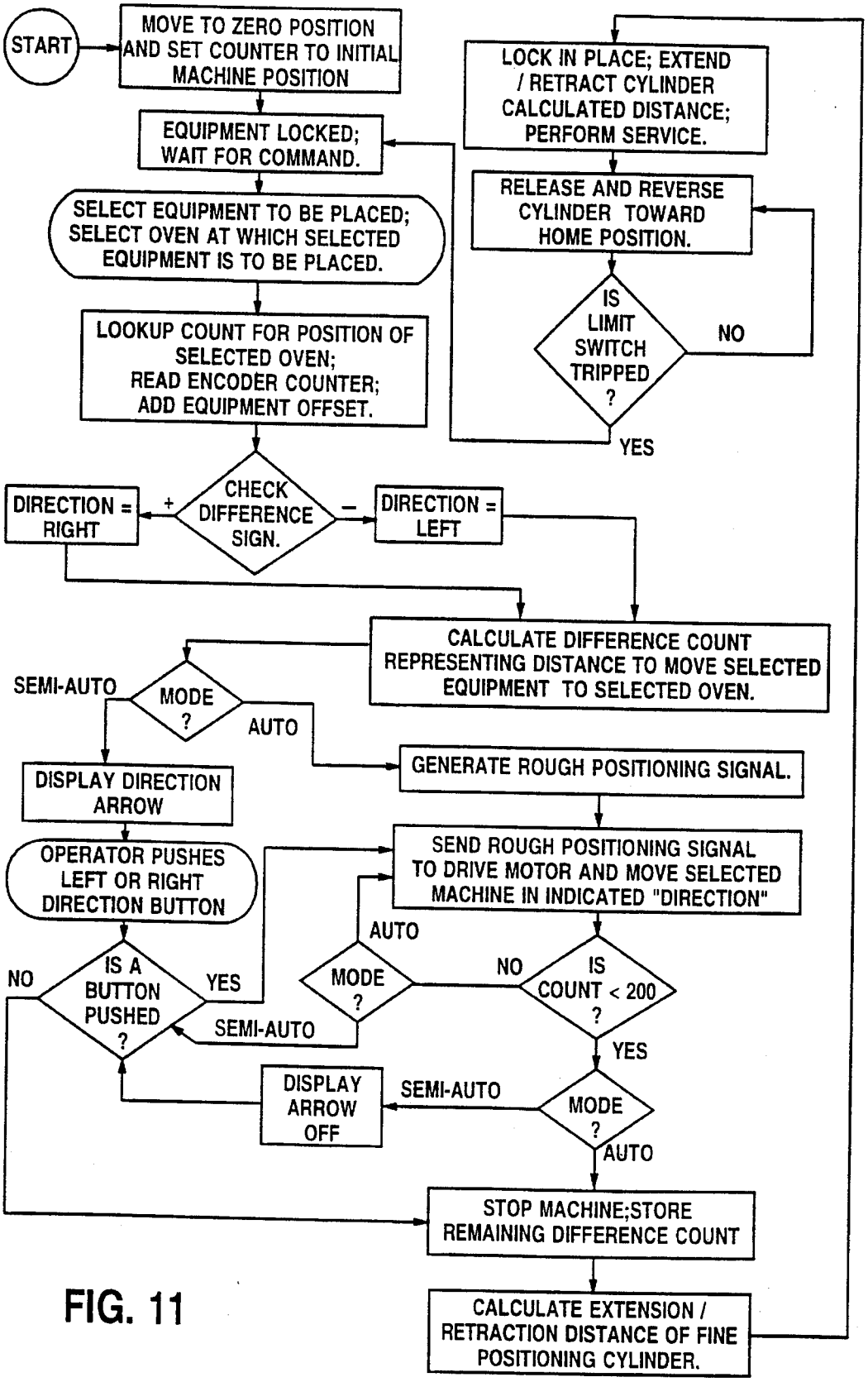
FIG. 11 is a flowchart of the program controlled operation of the spotting system of FIGS. 1–10.

The operation of the present invention is illustrated by the flowchart of FIG. 11, which represents the program loaded into a memory and executed by a microprocessor within the controller 110 (FIG. 2). In the system of the present invention, and referring now to FIGS. 1–11, an operator first selects the piece of functional equipment to be placed on spot. The operator might select, for example with the system of the present invention installed on the pusher side machine, the respective pusher side door extractor, door cleaner, jamb cleaner, pusher ram, or leveler, or for example with the system of the present invention installed on the door or coke side machine, the respective coke side door extractor, door cleaner, jamb cleaner, or coke guide. Each piece of equipment, which is carried by either the machine 12 or machine 14, is mounted at a different position on the machine 12 (14), and thus requires a slightly different position of the machine 12 (14) with respect to a selected oven for its use. Therefore, the selection of the piece of equipment is in effect the selection of an offset distance that must be added or subtracted from the existing position of the machine 12 (14) adjacent the oven at which it is to be placed. Having selected the piece of equipment to be spotted, the operator then selects the particular oven for which the selected piece of functional equipment is to be placed on spot relative thereto. The operator selects these two items, that is functional equipment and oven, by simply pressing the appropriate buttons on the Panelview display operator I/O interface 112.

Once these two selections have been made, the Panelview display operator interface 112 sends an appropriate signal to the programmable logic controller 110. The logic controller 110 has stored in a memory within it a count representing the position of the machine 12 with respect to the assembly of ovens 20–24, or, more precisely, with respect to a reference point at one end of the bank of ovens. The precision with which the position is represented is determined by the resolution of the encoder/pulse generator 106. In the system described above, the encoder/pulse generator generates 500 pulses per revolution of its shaft, which is translated by the gear and sprocket ratio connected to the shaft into a distance of 0.025 inch per count. Thus, the memory records the exact position of the machine 12 to 0.025 inch accuracy with respect to the ovens. The interface 112 and controller 110 are provided with means for initially calibrating the counter to "zero" the count to a known initial reference position, at a given position of the track or rails 60, 62 (88, 90) as by a limit switch (not shown). This "zero" count is automatically set when the machine is powered up and traveled to its initial reference position (limit switch), whereupon the counter is initially set. Then, for every 0.025 inch that the machine moves thereafter from the initial positions, the count in the counter is increased or decreased by a count of one, depending on the direction of travel.

Thus, when the controller 110 receives the settings from the operator via the interface 112, the controller will already have received a signal from the encoder 106 and determined the exact position, within 0.125 inch, of the machine 12 with respect to the bank of ovens. This position may be at the initial reference position, or, if the machine 12 (14) has been moved, may be at the last position to which it was moved. The programmable logic controller 110 then determines the direction and/or direction and distance the machine is to be traveled by calculating the difference between the count that represents the position of the machine 12 (14) and the count that would represent the position of the machine 12 (14) if accurately positioned at the oven that has been selected by the operator. The oven position is a number stored in memory in the controller 110 for each oven, and represents the count for an arbitrary, for example, centered position of the door extractor 70 on machine 12 (14) at the selected oven. The oven position count is, however, offset to account for the offset distance of the selected piece of equipment from the door extractor 70 on the machine 12 (14), by adding or subtracting an offset number, corresponding to which piece of equipment has been selected, to or from the centered position. Based on this calculated difference in count, the controller 110 sends a signal to the operator interface 112.

In the semi-automatic version of the system, the operator is prompted with the direction in which the machine 12 (14) must travel, and the operator must manually operate the travel controller to move the machine 12 (14) in the correct direction indicated on the Panelview display. When the machine 12 (14) arrives within approximately five (5) inches of the destination position relative to the selected oven, which it will do if the operator holds down the travel controller, the display changes, informing the operator to stop the machine 12 (14). By releasing the travel controller the motion of the machine 12 (14) stops.

In the fully automatic version of the system, or when operating in a fully automatic mode, the machine 12 (14) moves to the calculated first or rough position without the operator operating the travel controller via pushing a selected direction travel button on the Panelview display. In this automatic mode, in response to the calculated difference signal from the controller 110, the operator interface 112 still illuminates a display indicator on its panel to inform the operator of the direction in which the machine 12 (14) is to be moved in order to place the functional equipment on spot relative to the selected oven. The machine 12 (14), however, will automatically travel in the direction for which the Panelview display is indicating the machine must be moved to place the functional equipment on spot. To do this, the programmable logic controller 110 sends a first or rough positioning signal to the motor 102 to engage drive assembly 100.

In response to the first or rough positioning signal, the motor 102 engages the drive assembly 100 and drives the machine 12 (14) in the indicated direction of travel. As the machine 12 (14) travels, the encoder continues to send pulses to the controller 110, one for each 0.025 of an inch of travel of the machine 12 (14) with respect to the ovens, which pulses are subtracted from the difference count that had been calculated. When the machine is within approximately five (5) inches from the true on spot location, that is, when the difference count has been decremented or incremented by the addition or subtraction of the pulses to or from a predetermined count, the programmable logic controller 110 sends a signal to the motor 102 and the motor 102 ceases to drive the drive assembly 100.

After the first or rough positioning motion has stopped the machine 12 (14) within approximately five (5) inches of its destination, the programmable logic controller 110 then sends a fine positioning signal to the hydraulic power unit 114 for powering the absolute spotting positioner 120. Based on the distance that the functional equipment is from the true on spot location, which might be represented by a difference count of 200 or of some other count near 200 that depends on how precisely the machine 12 (14) was brought to a stop, the programmable logic controller 110 sends an appropriate signal to the hydraulic power unit 114, to clamp the disk calipers or clutch band and either extends or retracts the hydraulic cylinder 140 as necessary to rotate the caliper bracket 136 or 152 or the clutch band 172 through an arc which will result in the desired amount of linear travel. The extension or retraction distance necessary to bring about the rotation that corresponds exactly to that which will move the machine 12 (14) to its final desired position is the distance it will travel. Once the caliper bracket 136 or 152 or clutch band 172 has been moved to the correct location by the hydraulic cylinder 140, the hydraulic positioner 120, or, more likely, the spotting system brake 122 then holds the machine 12 (14) motionless relative to the set of tracks 60, 62 (88, 90). Thus, when the desired location is reached, the machine 12 (14) will stop precisely, within approximately ⅛ of an inch, from the desired oven position. This distance will correspond to a difference count of within 5 counts in the memory of the controller 110. The machine 12 (14) and its corresponding functional equipment is at that point precisely on spot relative to the selected oven, and the programmable logic controller 110 sends a signal to the display 112 to so indicate the same. The oven may then be serviced in the usual manner by the functional equipment. After the service has been performed and upon the selection of another spot the programmable logic controller 110 sends another signal to the hydraulic power unit 114 which releases the calipers 138 or 160 or the clutch band tensioning cylinder 174. At that point the programmable logic controller 110 then sends another signal to the hydraulic power unit 114 which moves the hydraulic cylinder 140 in the reverse direction, or back to the home position as indicated by the home limit switch 116. Once the home switch 116 indicates that the hydraulic cylinder 140 is back in the home location, the home switch 116 sends a signal to the programmable logic controller 110 which in turn sends a signal to the hydraulic power unit 114 ceasing operation of the hydraulic cylinder 140.

Thus, in the fully automatic version of the present invention, the step of manually traveling the machine 12 (14) to within approximately five (5) inches of the selected oven is eliminated, as an operator simply enters the desired oven number and the functional equipment with which to engage the oven into the Panelview 112, which sends a signal to the programmable logic controller 110, which sends a signal to the motor controller 124, which actuates the motor 102, which in turn actuates drive assembly 100 to automatically place the machine 12 (14) within approximately 5 inches of the selected oven. In response to the count from the encoder 106, the programmable logic controller 110 sends a signal to the motor controller 124 to disengage the motor 102 by sending a signal to the hydraulic power unit 114, which in turn controls the hydraulic cylinder 140 and calipers 138 or 160, or brake band tensioning cylinder 174, in the same manner as in the semi-automatic form of the invention to place the functional equipment on spot.

Figure 12:
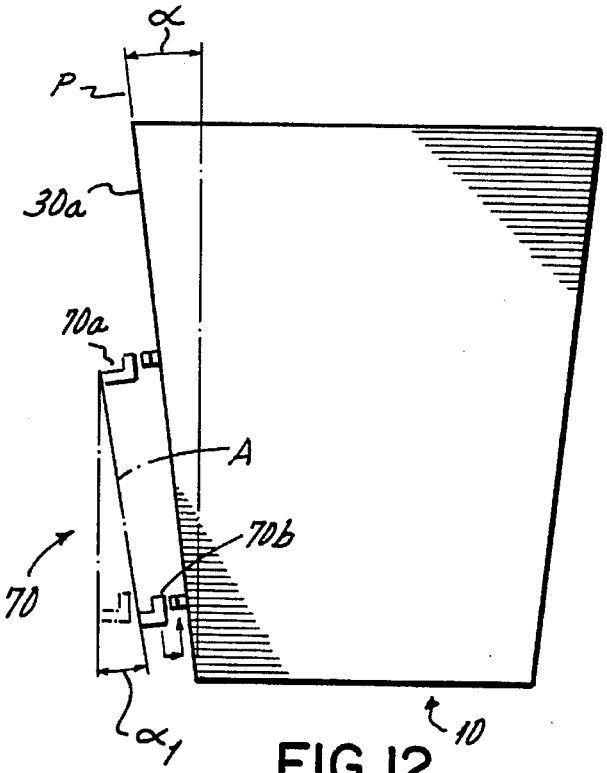
FIG. 12 is a side elevational view of the coke oven battery of FIG. 1 illustrating, in greatly exaggerated fashion, the front-to-back tilting of a coke oven door jamb due to thermal distortion of the battery.
Figure 13:
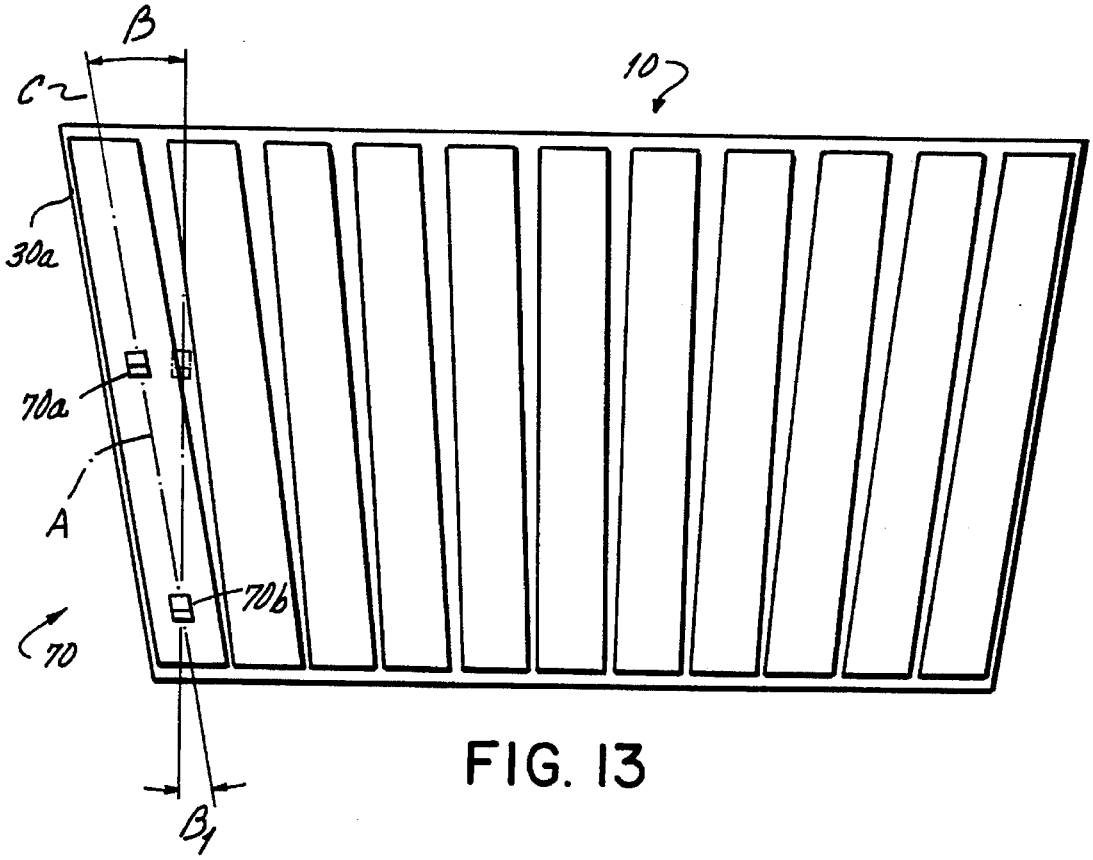
FIG. 13 is a front elevational view of the coke oven battery of FIG. 1 illustrating, in greatly exaggerated fashion, the side-to-side leaning of a coke oven door jamb due to thermal distortion of the battery.

Referring now to FIGS. 12 and 13, the coke oven battery 10 is shown in its thermally distorted state (greatly exaggerated), due to the thermal strains encountered by the coke oven battery 10 caused by the tremendous heat generated by the ovens. In FIG. 12 it will be seen that a plane P (in edge view) parallel to and including the coke oven door jamb 30*a* deviates or otherwise departs from true vertical by an angle $\alpha$. Similarly, as illustrated in FIG. 13 (in front elevational view), a height centerline axis of symmetry C departs from true vertical by an angle $\beta$. Door extractor 70 having upper and lower door engagement supports 70*a* and 70*b* must be oriented such that an axis A defined by the upper and lower door supports 70*a*, 70*b* is approximately parallel to the plane P and the centerline C in order to prevent undue pressure from being applied to the door, door jamb, door seal, door refractory plug components, etc. during removal of the door from the jamb and installation of the door onto the jamb. Thus, door engaging supports 70*a* and 70*b* must be moved in individually differing amounts by an amount equal to $\alpha_1$ relative to plane P, and by an amount equal to $\beta_1$ relative to centerline C, in order to bring the axis A defined by the supports 70*a* and 70*b* into a parallel relationship with door jamb plane P and door height axis C, where $\alpha_1$ equals $\alpha$ and $\beta_1$ equals $\beta$.

In addition, it will be appreciated that individual oven doors may vary in vertical height relative to one another along the length of the battery. Such variations are due to a number of factors, such as coke build up on hearths, and deviation in elevation of the ovens and relative to another. Further, the tracks 60, 62 atop which the machine rolls can deviate vertically relative to the battery along the length of the battery. Thus door supports 70*a* and 70*b* must be movable vertically to account for relative differences in height of the oven doors along the battery.

Referring now to FIGS. 14–30, and first in particular to FIGS. 14–19, the door extractor 70 of the present invention which has the capability of moving its door engaging hooks or door supports 70*a* and 70*b* in individually differing amounts relative to the door jamb plane P and the door jamb height axis C in order to compensate for the front-to-back tilting and side-to-side leaning of the coke oven door jamb due to thermal distortion of the battery and vertically to compensate for relative differences in vertical height of individual doors is illustrated. The door extractor 70 comprises, generally, a first frame 200 which is mounted to a coke oven rail car 12 (phantom, FIG. 20), a second frame 300 movably mounted on the first frame 200, a third frame 400 having the door engaging supports 70*a* and 70*b* movably mounted on the second frame 300, and a fourth frame 500 movably mounted on the first frame 200.

More particularly, the first frame 200 includes vertical support columns 201 and 202 connected at their upper ends with a horizontal plate 203 and connected at their lower ends with a horizontal plate 204. Frame 200 includes a pair of upper longitudinal girders 205 and 206 secured to vertical support columns 201 and 202 respectively. Each of the girders 205 and 206 includes a pair of L sections 207 and 208 secured on inwardly facing surfaces thereof forming a horizontal track or channel 209 therebetween. An end plate 210 is secured to each end of the L section pairs 207, 208 thereby defining an enclosed track.

Similarly, the lower ends of the vertical support columns 201 and 202 have secured thereto lower longitudinal girders 211 and 212 respectively. Each of the girders 211, 212 has secured thereto on inwardly facing surfaces thereof a pair of sections 213 and 214 which define a channel 215 therebetween. An end plate 216 is secured to each end of the L section pairs 213, 214 thus defining an enclosed horizontal track. Stiffening plates 217 connect the girders 205, 206 and 211, 212 to the vertical support columns 201 and 202.

Supplemental vertical support columns 218 and 219 are connected to and span between upper and lower girders 205, 211 and 206, 212, respectively. Supplemental vertical support columns 218 and 219 are connected to the main vertical support columns 201 and 202 via trusses 220. A pair of elongated plates 221 and 222 are secured to upper and lower ends of each of the supplemental vertical support columns 218 and 219, thus defining vertical channels or tracks 223 therebetween.

A pair of inverted L sections 224 and 225 are secured to the rearward and forward edges of top plate 203. The foot portions 224*a*, 225*a* of each of the inverted L sections 224, 225 slidably capture the rearward and forward edges of a pivot shaft plate 226. The pivot shaft plate 226 includes an upwardly projecting pivot shaft 227 which rotatably resides within a cylindrical bore of a radial spherical bearing 228. Bearing 228 is preferably a QUADLUBE™ bearing manufactured by Roller Bearing Company of America, West Trenton, N.J. Spherical bearing 228 is housed in a radial spherical bearing support cap 229 which is topped with a bearing support plate 230. Plate 230 is in turn fixedly secured to the coke oven rail car 12.

Pivot shaft plate 226 includes a clevis 231 for receiving the piston end 232 of a hydraulic cylinder 233. The cylinder end 234 of the hydraulic cylinder 233 is connected to a bracket 235 which is secured to the upper end of vertical support column 201.

Pivot shaft plate 226 further includes an upstanding plate 236 having the piston end 237 of another hydraulic cylinder 238 connected thereto. The cylinder end 239 Of the hydraulic cylinder 238 is connected to the coke oven rail car 12.

A similar pivot shaft plate 244 is secured to the lower horizontal plate 204 of the first frame 200 and includes a pivot shaft 241. The pivot shaft 241 is received within a bore of a like radial spherical bearing 242 which is housed within a spherical bearing support cap 243 to which is attached a bearing support plate 240. Bearing support plate 240 is fixedly secured to the coke oven rail car 12. (See, for example, FIG. 20).

Figures 14A, 18, 19:
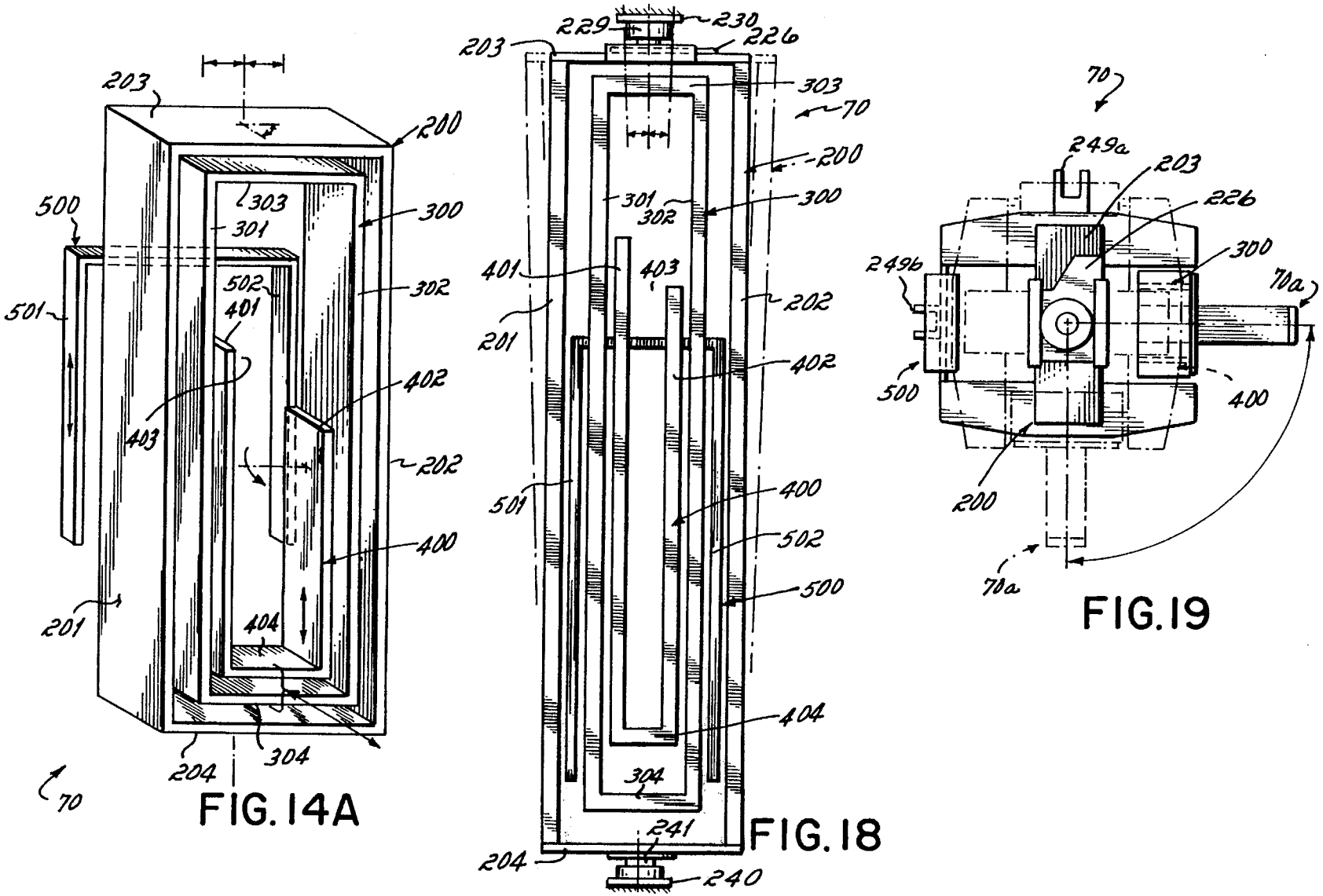
FIG. 14A is an assembled schematic perspective view of the door extractor and its range of motion.
FIG. 18 is a front elevational view of the door extractor and the range of pivotal lean motion of the door extractor.
FIG. 19 is a top plan view of the door extractor and the range of rotational motion of the door extractor.

Thus, extending and retracting hydraulic cylinder 233 causes top plate 203 and hence inverted L sections 224 and 225 to slide relative to pivot shaft plate 226, which is effectively grounded to the coke oven rail car 12 by virtue of its connection to plate 230, which is fixed to the rail car 12, through the pivot shaft 227 and spherical bearing 228. And, since the lower end of the frame 200 is connected to the coke oven rail car 12 through a similar spherical bearing support, first frame 200 is able to pivot at its lower end relative to the coke oven rail car 12 about that lower spherical bearing or pivot connection. Such pivoting motion results in the ability of the door extractor to move the door engaging supports 70*a*, 70*b* through an angle $\beta_1$ which is equal to $\beta$ (FIGS. 13, 14A and 18).

Second frame 300 includes a pair of vertical support columns 301 and 302 connected at upper and lower ends with horizontal support plates 303 and 304 respectively. A pair of rollers 305 and 306 is connected to each upper and lower end of each of the vertical support columns 301 and 302. The upper two pairs of rollers ride in the channels or tracks 209 at the upper end of the first frame 200, while the lower pairs of rollers ride in the lower channels or tracks 215 of the first frame 200. Thus, the second frame 300 can translate horizontally relative to the first frame 200 by virtue of its rolling connection therewith.

Third frame 400 includes a pair of vertical support columns 401 and 402 unconnected at their upper ends 403 and connected at their lower ends with a bottom plate 404. Upper and lower door engaging supports 70*a* and 70*b* are connected to the support columns 401 and 402 through, and form a part of, generally L-shaped hooks 71*a* and 71*b* respectively. A roller 405 mounted to the upper end of each of the vertical supports 401, 402 rides in an upper slot 307 in each of the vertical support columns 301 and 302 of the second frame 300. Similarly, a roller 406 mounted on the lower end of each of the vertical support columns 401 and 402 rides in a lower slot 308 in each of the vertical support columns 301 and 302 of the second frame 300. Rearward and forward transverse supports 309 and 310 are mounted atop cleats 311 which are secured to forward and rearward edges of the vertical support columns 301 and 302 of second frame 300. Supports 309 and 310 support a plate 312 which has connected thereto the cylinder end 313 of a hydraulic cylinder 314. The piston end 315 of the hydraulic cylinder 314 is connected to a plate 407 connected to and spanning between the vertical supports 401 and 402 of the third frame 400. Thus, extending and retracting the cylinder 314 causes the third frame 400 to roll upwardly and downwardly relative to the second frame 300.

Figure 14:
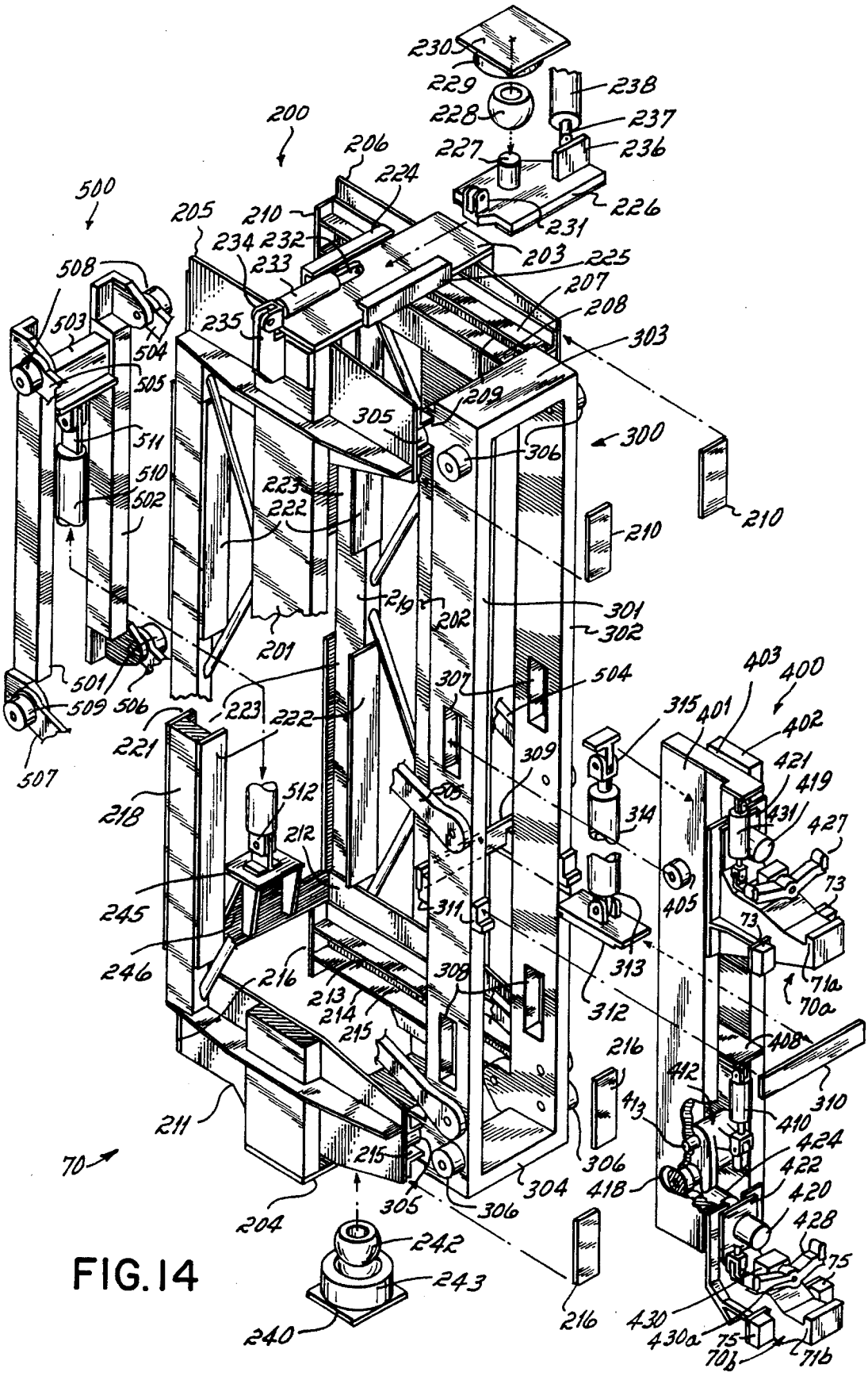
FIG. 14 is an exploded, disassembled perspective view of the coke oven door extractor of the present invention.
Figure 21:
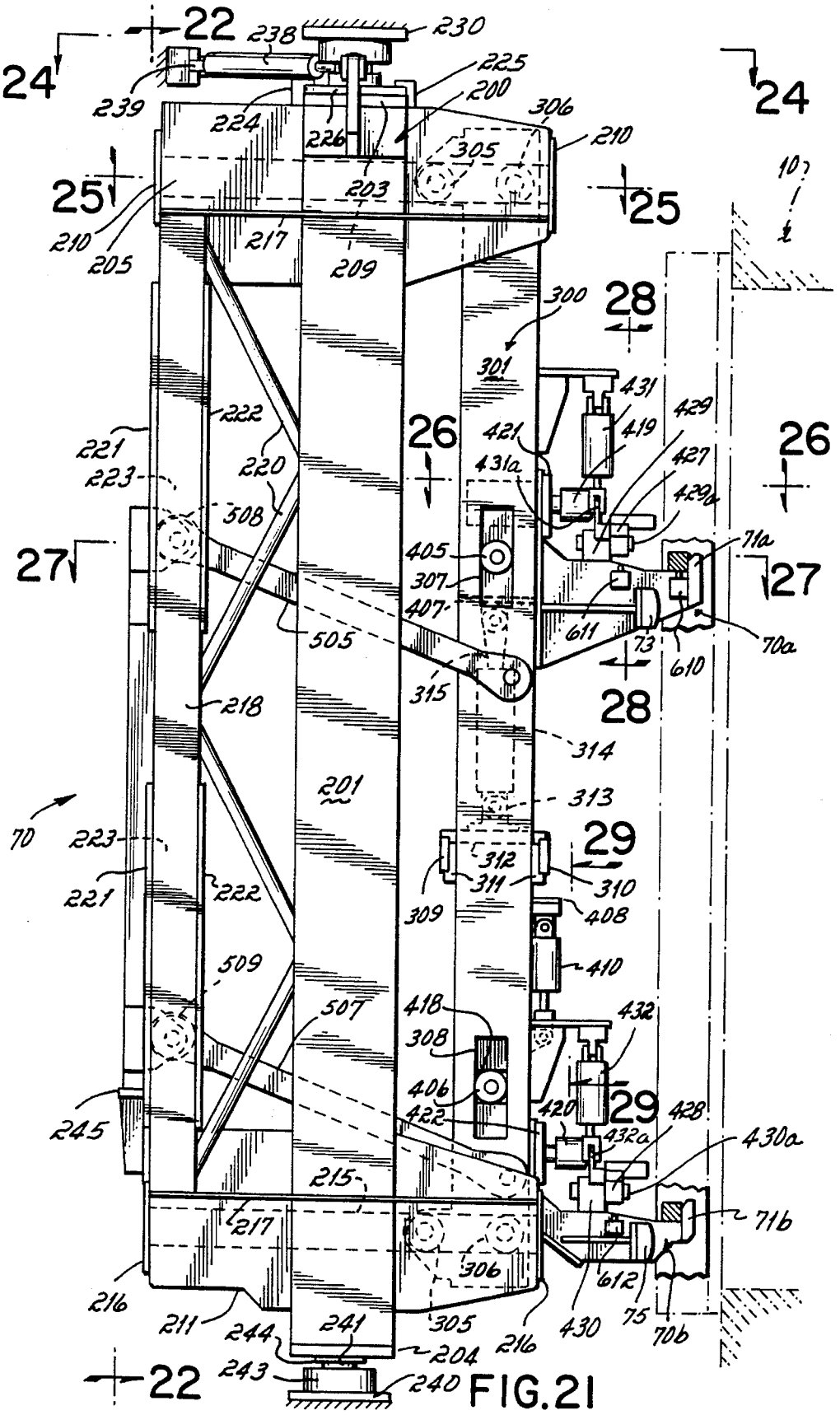
FIG. 21 is a view of the door extractor taken along line 21—21 of FIG. 20.
Figure 22:
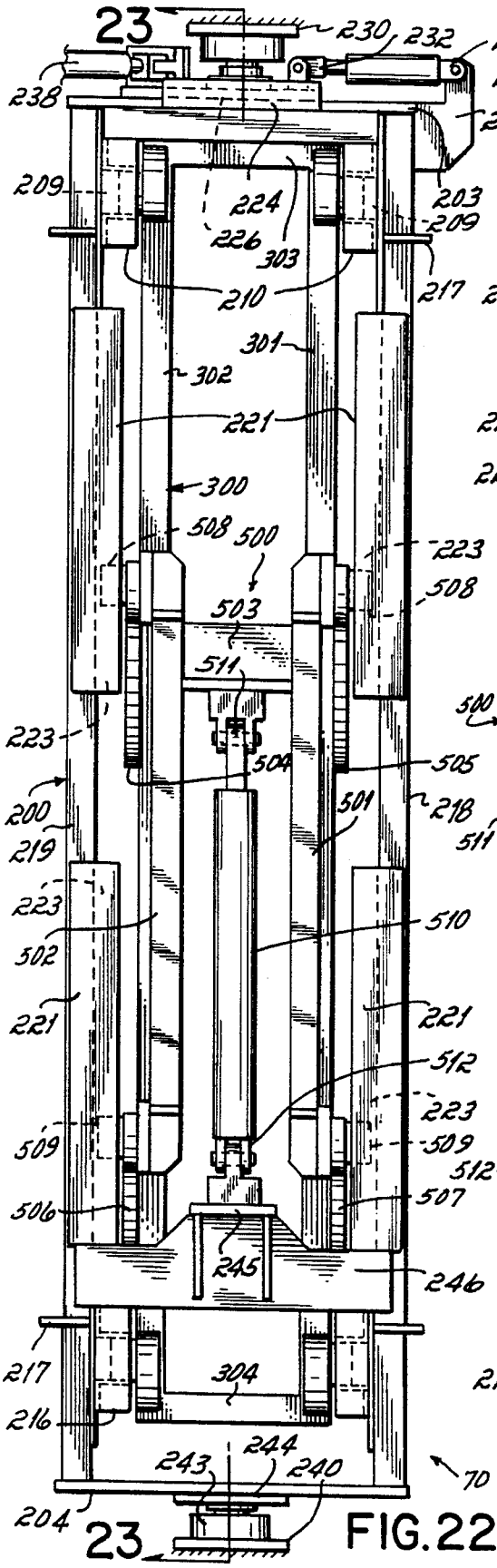
FIG. 22 is a view of the door extractor taken along line 22—22 of FIG. 21.
Figure 23:
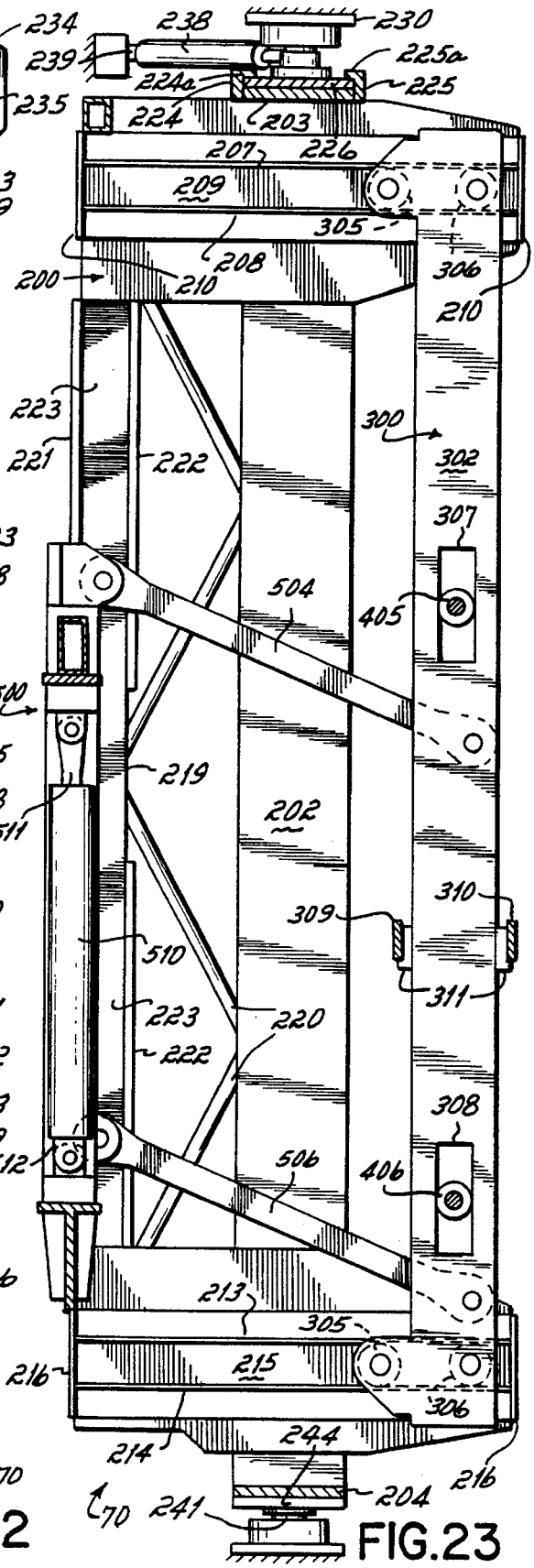
FIG. 23 is a view of the door extractor taken along line 23—23 of FIG. 22.
Figure 30:
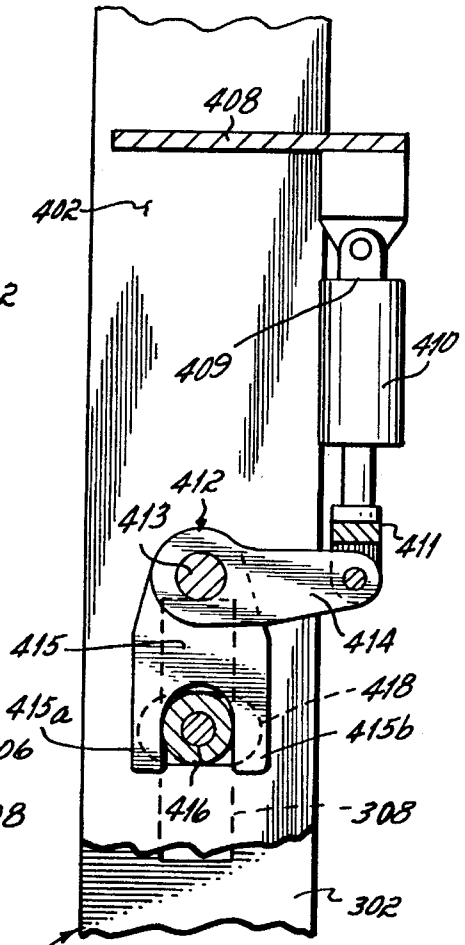
FIG. 30 is a view of the door extractor taken along line 30—30 of FIG. 29.
Figure 29:
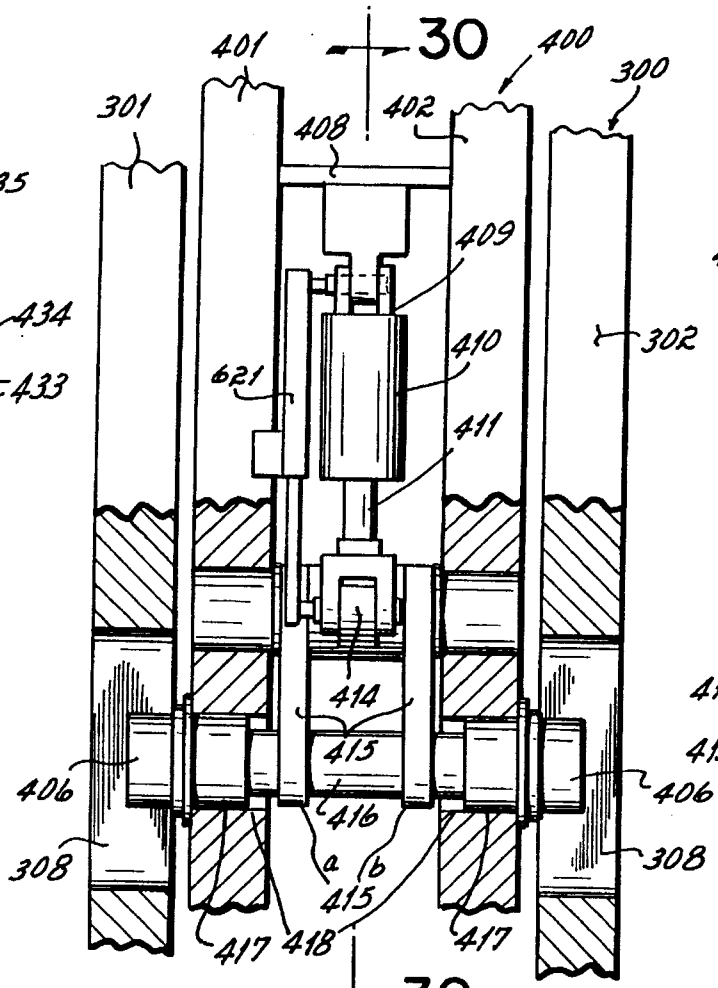
FIG. 29 is a view of the door extractor taken along line 29—29 of FIG. 21.

Third frame 400 further includes an intermediate plate 408 connected between and to vertical supports 401 and 402. Plate 408 has the cylinder end 409 of a hydraulic cylinder 410 connected thereto. The piston end 411 of the cylinder 410 is connected to a toggle link 412 which is pivoted to the vertical supports 401 and 402 via shaft 413. Toggle link 412 includes the first arm 414 to which the piston end 411 of the cylinder 410 is connected, and a pair of second arms 415 each having downwardly extending fingers 415*a* and 415*b*. These fingers 415*a* and 415*b* capture a shaft 416, the ends of which have the rollers 406 rotatably mounted thereto. Mounted inboard of each of the rollers 406 is another roller 417, which is adapted to roll in slot 418 in each of the vertical supports 401 and 402. Rollers 406 are restrained from longitudinal movement in slots 308 in vertical supports 301 and 302 of frame 300 (FIGS. 21, 29 and 30). Thus, when hydraulic cylinder 410 is extended and retracted, the action of fingers 415*a* and 415*b* on shaft 416 as toggle link 414 rotates causes the lower end of the second frame 400 to pivot forwardly and backwardly about the upper rollers 405 which are supported in slots 307 of vertical supports 301, 302 of the second frame 300. Thus, motion of hydraulic cylinder 410 gives rise to the ability of the door extractor to move the supports 70*a* and 70*b* through an angle $\alpha_1$ which is equal to $\alpha$ (FIGS. 12, 14 and 17).

Figure 26:
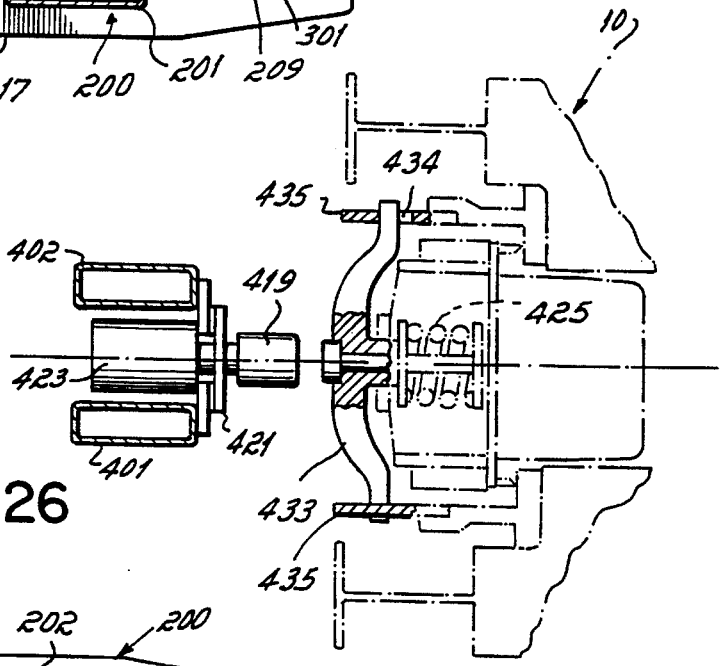
FIG. 26 is a view of the door extractor taken along line 26—26 of FIG. 21.
Figure 27:
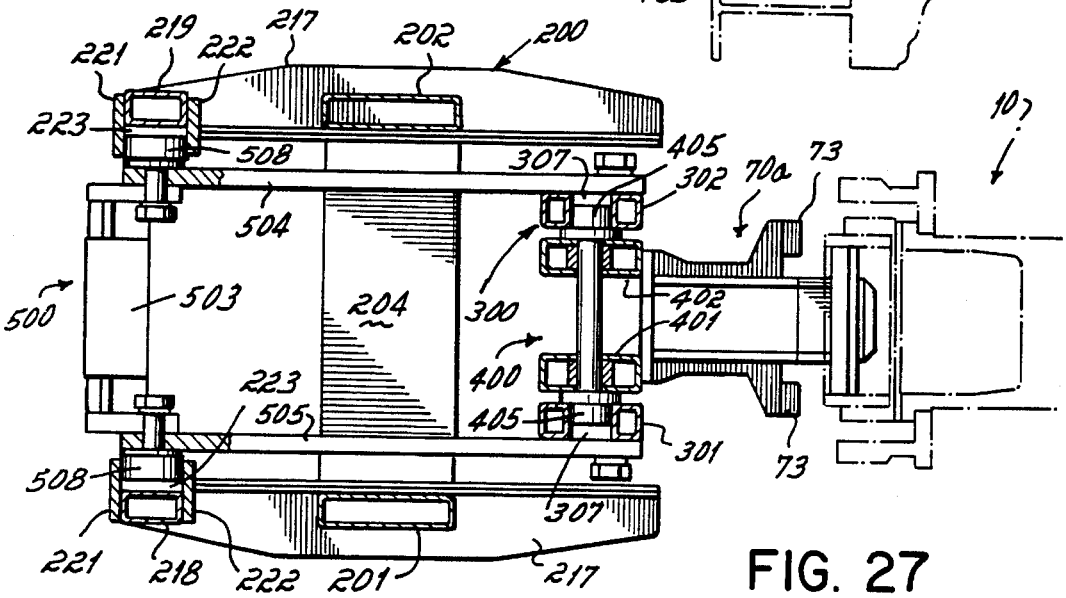
FIG. 27 is a view of the door extractor taken along line 27—27 of FIG. 21.
Figure 28:
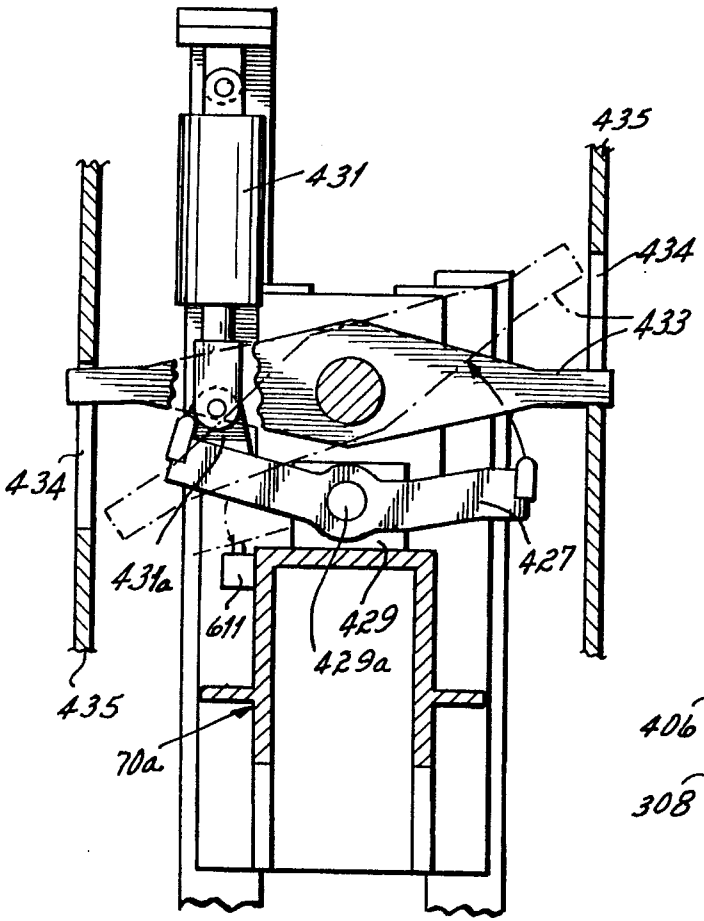
FIG. 28 is a view of the door extractor taken along line 28—28 of FIG. 21.

Third frame 400 includes additional structure for latching and unlatching coke oven doors from their respective coke oven door jambs. More particularly, third frame 400 includes upper and lower plungers 419 and 420 (see also FIGS. 21 and 26) mounted for horizontal travel through plates 421 and 422, respectively, and actuated by hydraulic cylinders 423 and 424, respectively. The plungers 419 and 420 are operable to compress upper and lower oven door compression springs, the upper one of which is shown at 425 (FIG. 26). Upper and lower levers 427 and 428, respectively, pivot about generally horizontal axes perpendicular to the coke oven door on shafts 429 and 430, respectively. Shafts 429*a* and 430*a* are mounted for pivotal movement within blocks 429 and 430 respectively which are mounted to the foot portions of L-shaped hooks 71*a* and 71*b* respectively. Each lever 427, 428 is actuated by a respective hydraulic cylinder 431, 432 through a respective offset 431*a*, 432*a* (See also FIGS. 21 and 28). Extending and retracting the hydraulic cylinders 431, 432 rotates levers 427 and 428 to latch and unlatch the upper and lower coke oven door locking arms, the upper one of which is shown in FIG. 28 at 433, into and from slots 434 in latch retainer plates 435.

Fourth frame 500 includes a pair of vertical supports 501 and 502 connected at their upper ends with a cross brace 503. A parallelogram linkage in the form of a pair of upper links 504 and 505 connected to the upper ends of vertical supports 501 and 502, and a lower pair of links 506 and 507 connected to the lower ends of vertical supports 501 and 502, connects the fourth frame 500 with the second frame 300. Upper rollers 508 are connected to the upper ends of the vertical supports 501, 502 while lower rollers 509 are connected to the lower ends of vertical supports 501, 502. Upper and lower rollers 508, 509 roll in the upper and lower vertical channels 223 of the first frame 200.

Figures 15, 16, 17:
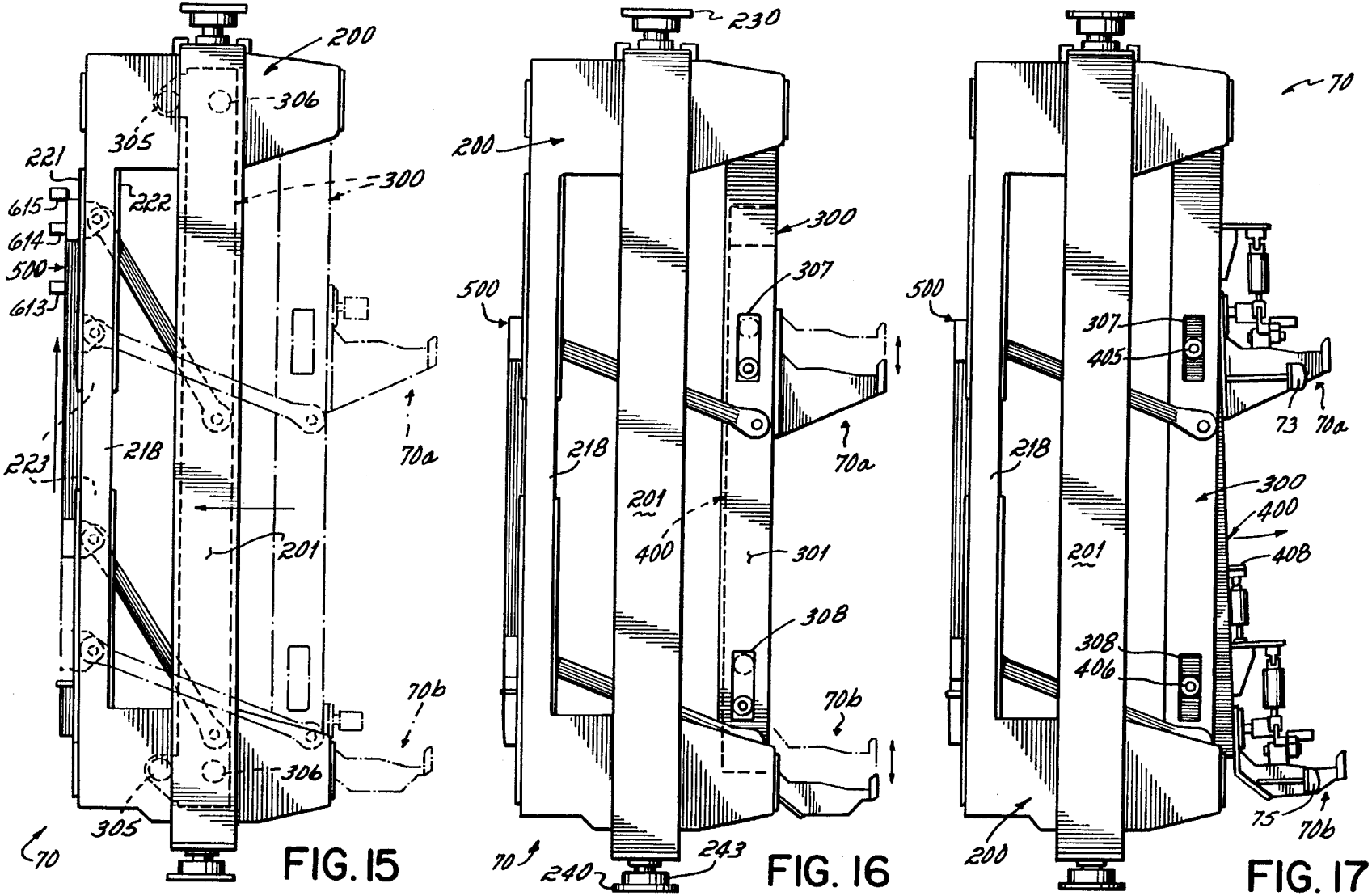
FIG. 15 is a side elevational view of the door extractor and the range of translational motion of the second and fourth frames.
FIG. 16 is a view similar to FIG. 15 of the range of vertical translational motion of the third frame.
FIG. 17 is a view similar to FIG. 15 of the range of pivotal tilt motion of the third frame.

A hydraulic cylinder 510 has a piston end 511 connected to the cross brace 503 and a cylinder end 512 connected to a bracket 245 which is secured to a plate 246 connected to and spanning between the lower ends of supplemental vertical support columns 218 and 219 of first frame 200 (See also FIGS. 15 and 21). Extending and retracting the cylinder 510 causes the fourth frame 500 to roll vertically downwardly relative to the first frame 200 which in turn causes the second frame 300 to roll horizontally forwardly relative to the first frame 200, and for the fourth frame 500 to roll vertically upwardly relative to the first frame 200 thus causing the second frame 300 to roll horizontally rearwardly relative to the first frame 200, respectively.

Figure 20:
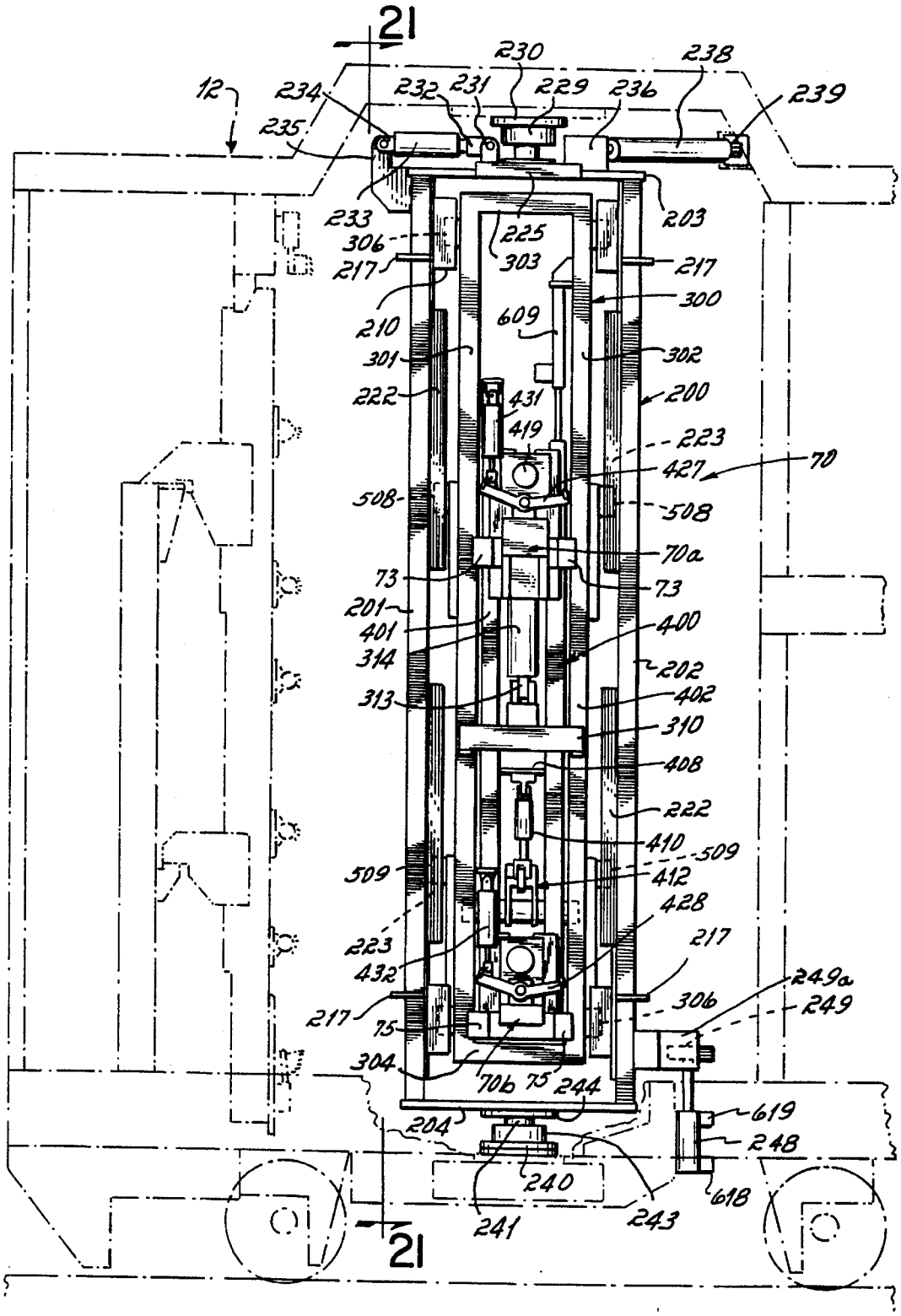
FIG. 20 is a front elevational view of the door extractor mounted on a coke oven rail car (phantom)
Figure 24:
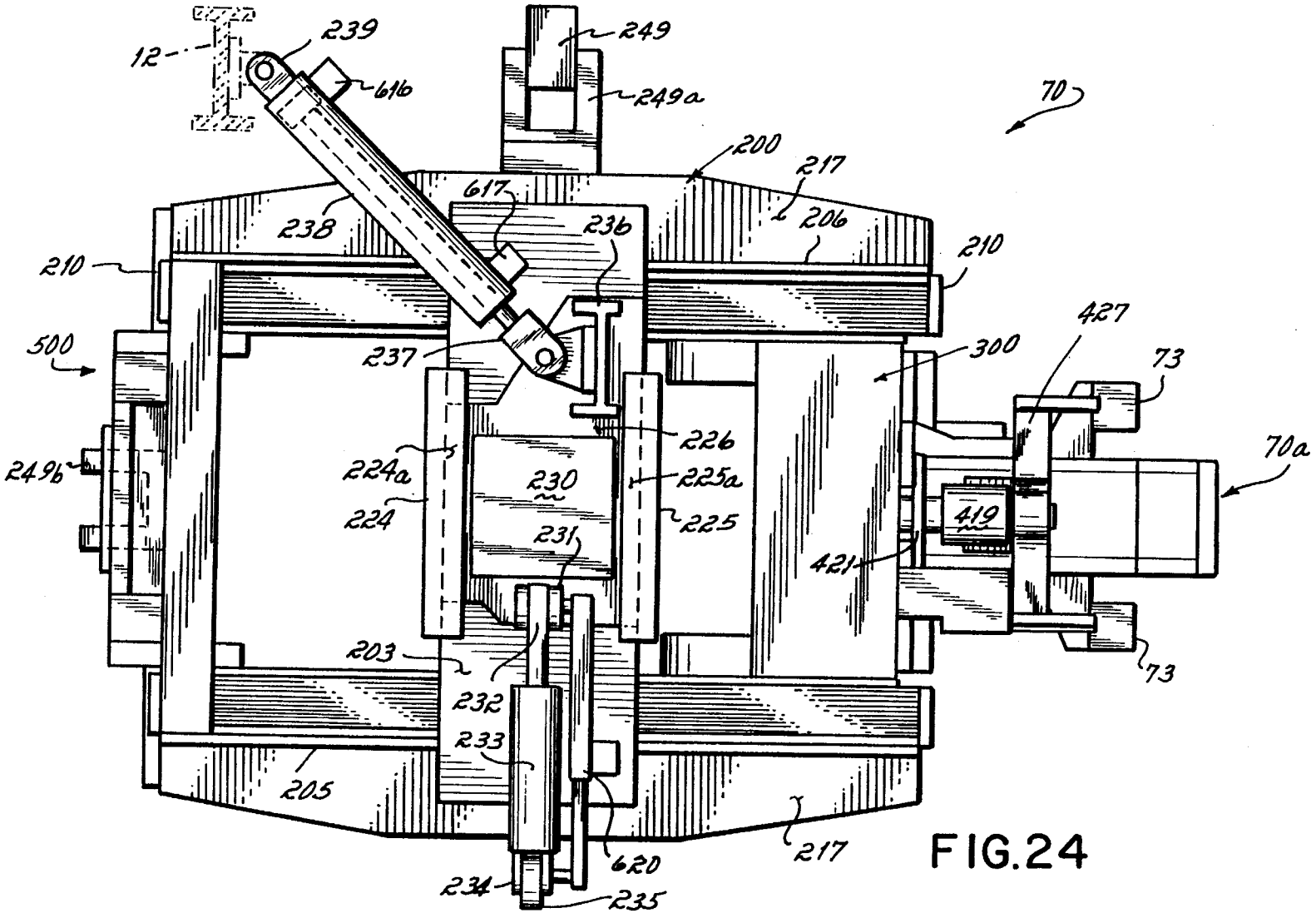
FIG. 24 is a view of the door extractor taken along line 24—24 of FIG. 21.
Figure 25:
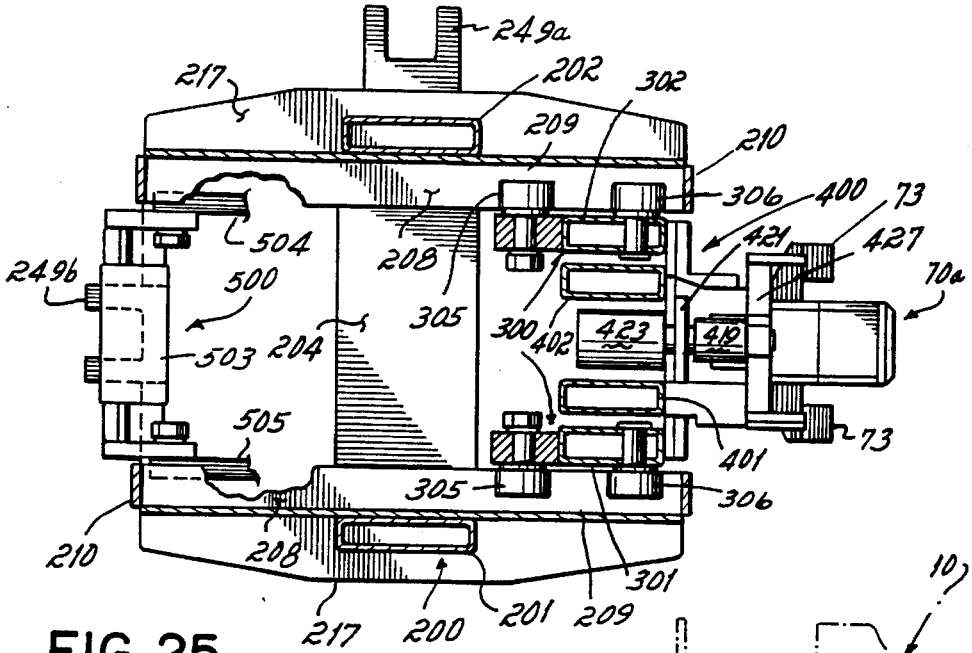
FIG. 25 is view of the door extractor taken along line 25—25 of FIG. 21.

Referring to FIGS. 19, 20 and 24, the first frame 200 has mounted thereto, at a lower end thereof, a pair of U-shaped brackets 249*a* and 249*b*. Brackets 249*a* and 249*b* are disposed at 90° relative to one another. A hydraulic cylinder 248 (FIG. 20) is mounted to the car 12 and moves a pin 249 up and down so as to engage and disengage one or the other of the brackets 249*a* or 249*b*. The pin 249 locks the door extractor 70 in either a position wherein the door extractor 70 is facing the battery 10 or facing the door cleaner 72 (90° from facing the battery 10).

Figure 31:
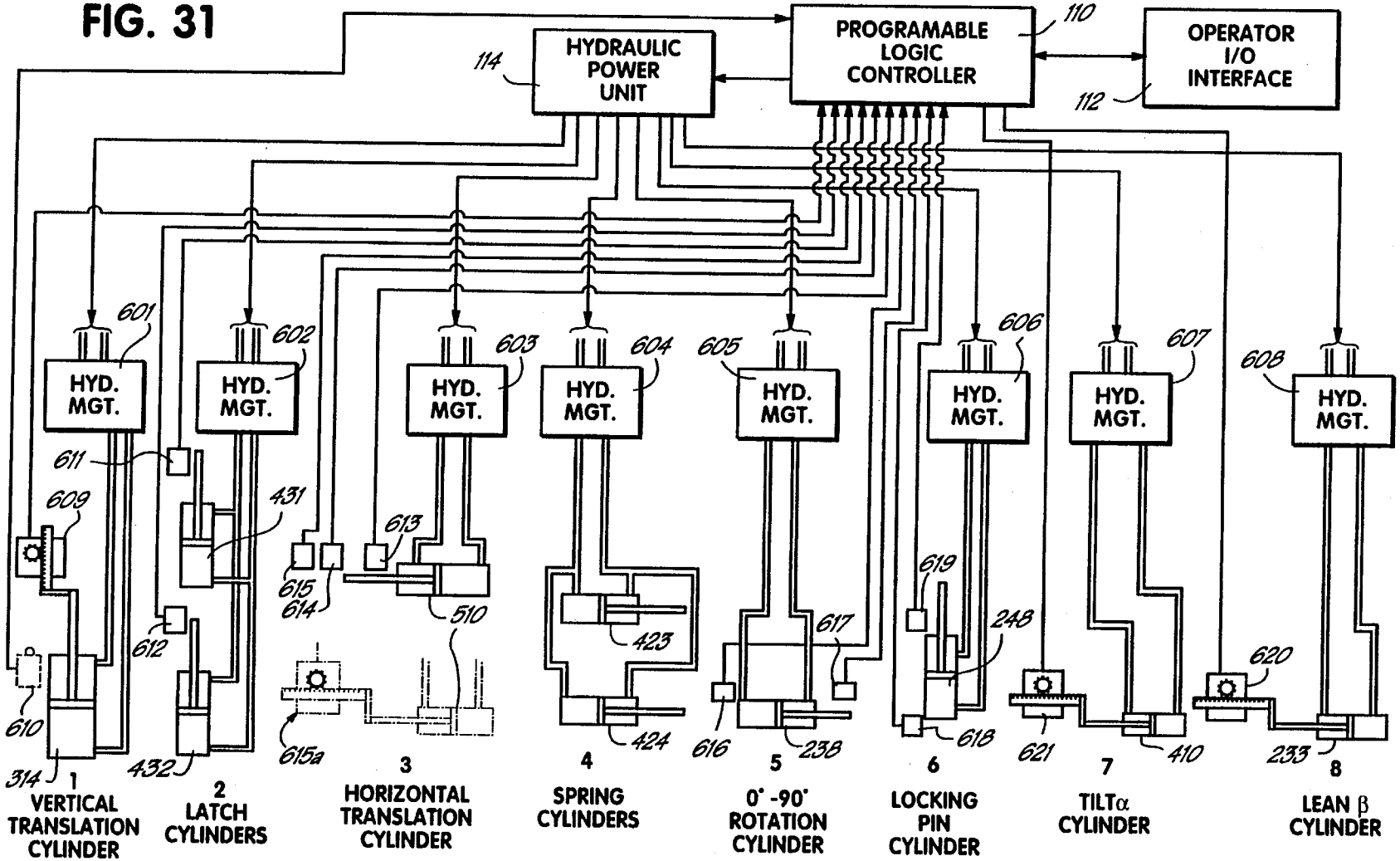
FIG. 31 is a schematic diagram illustrating the various hydraulic cylinders, position resolvers and limit switches of the door extractor.

Referring to FIG. 31, hydraulic power unit 114 supplies hydraulic power to eight hydraulic management units 601–608. Hydraulic management unit 601 actuates hydraulic cylinder 314 which raises and lowers frame 400 to lift and remove a door from its respective door jamb. An encoder 609 (FIG. 20) monitors the lifting of frame 400 and hence the coke oven door. A proximity switch 610 (FIG. 21) indicates when the coke oven door is on the door supports 70*a* and 70*b*.

Hydraulic management unit 602 actuates hydraulic cylinders 431, 432 for rotating levers 427 and 428, respectively, to latch and unlatch the upper and lower coke oven door locking arms, respectively. Limit switches 611 and 612 (FIGS. 21, 28) corresponding to the upper and lower levers 427 and 428, respectively, indicate when the door is unlatched.

Hydraulic management unit 603 actuates hydraulic cylinder 510 which raises and lowers fourth frame 500, thus retracting and extending, respectively, second frame 300. Three limit switches 613–615 (FIG. 15), indicate three positions of the second frame 300: fully retracted (615), eighty percent retracted (614) and eighty percent extended (613). Alternatively, an encoder 615*a* (shown schematically only in FIG. 31) either alone or in conjunction with limit switches 613–615 could be employed to indicate the position of the frame 300.

Hydraulic management unit 604 actuates hydraulic cylinders 423 and 424 which in turn operate upper and lower plungers 419 and 420, respectively, to decompress upper and lower door compression springs.

Hydraulic management unit 605 actuates hydraulic cylinder 238 for rotating door extractor 70 through its 90° of travel to and between positions wherein the door extractor 70 faces the coke oven and wherein the door extractor faces the door cleaner. Limit switches 616 and 617 indicate that the door extractor 70 is at the 0° and 90° locations, respectively.

Hydraulic management unit 606 actuates hydraulic cylinder 248 which locks and unlocks the door extractor 70 in either its 0° or 90° location. Limit switches 618 and 619 (FIG. 20) indicate whether the door extractor 70 is locked or unlocked.

Hydraulic management unit 607 actuates hydraulic cylinder 410 to tilt the third frame 400 in one direction or the other. Encoder 621 (FIG. 29) indicates the amount of tilt.

Hydraulic management unit 608 actuates hydraulic cylinder 233 which leans the door extractor 70 in one direction or the other. Encoder 620 (FIG. 24) indicates the amount of lean.

Figure 32:
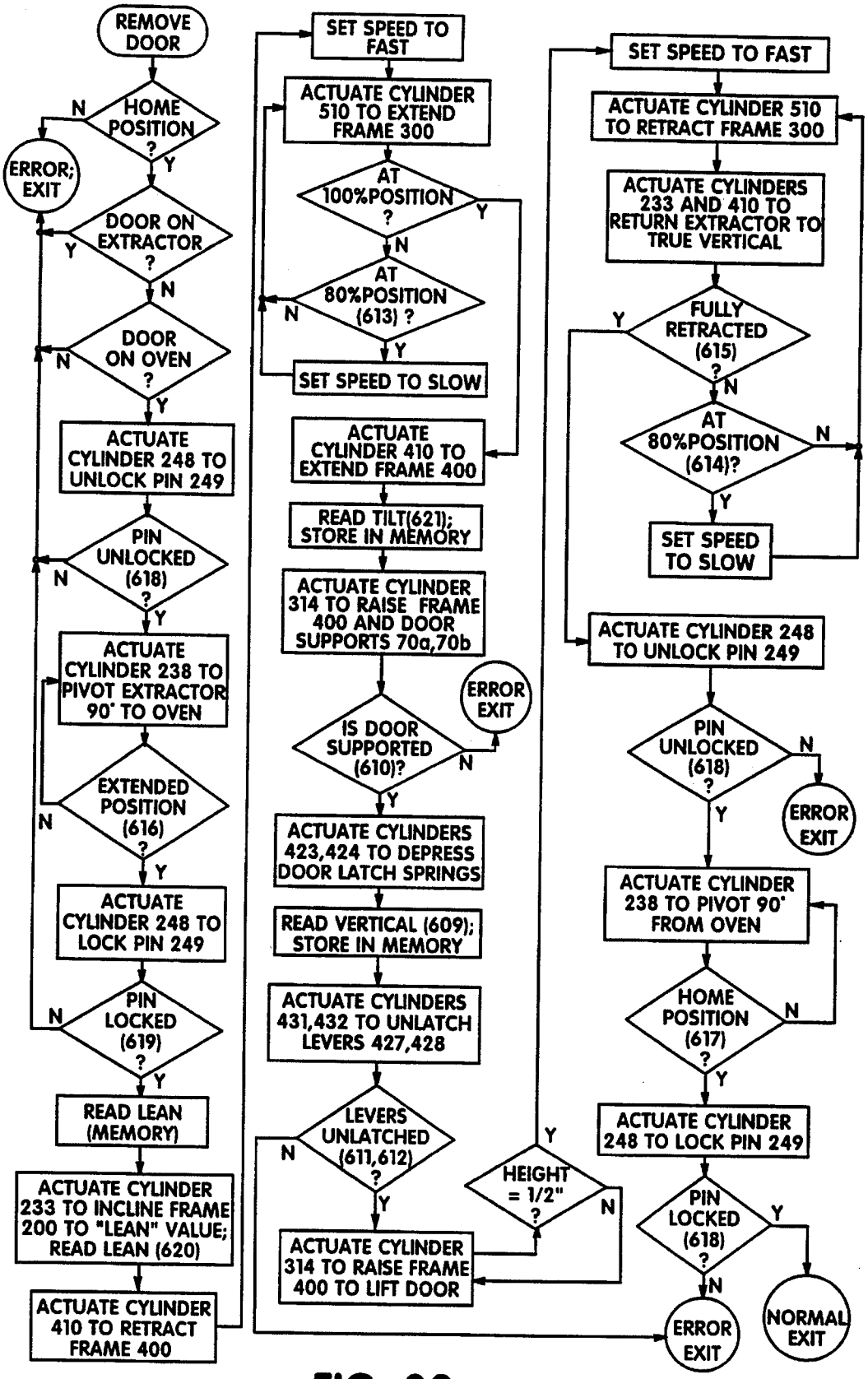
FIG. 32 is a flow chart illustrating the automatically controlled door removal sequence.

The operation of the extractor 70 to remove a door from a selected oven is illustrated in the flowchart of FIG. 32. Prior to the removal of a door, the operator will have moved the car 12 to a position such that the door extractor 70 is on spot relative to the selected one of the ovens. Then, the operator will input a button command at the operator I/O interface 112 to initiate a door removal sequence. When this command is given, the controller 110 first checks to verify that the extractor 70 is in the home position, which is a position in which the extractor 70 is adjacent the selected oven and oriented 90° to the oven and locked in position. When the door removal operation is selected, the controller 110 also checks to be sure that there is no door on the extractor supports 70*a*, 70*b*. The condition is checked, for example, by reading the status of switch 610. If this condition is not met, the controller 110 program terminates and displays an error message indicative of the condition.

The invention operates in the following manner to remove a door from its respective coke oven. With the extractor 70 rotated 90° to the oven (retracted, home location), the programmable logic controller 110 actuates hydraulic cylinder 248 moving locking pin 249 to the unlocked position. Proximity switch 618 sends an unlocked signal to the programmable logic controller 110, which then actuates hydraulic cylinder 238 to pivot the door extractor 70 through 90° so that the extractor now faces the oven (extended position). After receiving a signal from limit switch 616 that the extractor 70 is in the extended position, the programmable logic controller 110 actuates hydraulic cylinder 248 moving locking pin 249 into locking position to lock the door extractor 70.

After receiving a locked input signal from limit switch 619, the programmable logic controller 110 reads the lean angle $\beta$ for the door jamb of the selected oven from locations in the controller 110 memory. The value has been collected and stored by measuring the lean angle of each door when at standard operating conditions and storing the measurements in a table. The lean angle $\beta$ is measured and collected by an operator by manually adjusting the lean of the door extractor via cylinder 233 until visually the door extractor lean matches the door lean. The encoder 620 reading is then stored in memory, and the process is continued until the lean value for each oven has been stored. The tilt angle $\alpha$ is also measured by the door extractor, the specifics of which will be described below, but the tilt value is only temporarily stored in memory upon its being measured upon the extractor engaging the door. Once the measurement is noted and stored in memory, the door is removed. When the door is replaced, the temporarily stored tilt angle $\alpha$ is recalled and the extractor is properly tilted to replace the door. The tilt angle $\alpha$ is then erased from memory.

Then, the controller 110, reading the signal from the lean rotary encoder 620, leans the first frame 200 via hydraulic cylinder 233 to lean position $\beta_1$, which exactly matches the measured preprogrammed orientation $\beta$ of the door. Simultaneously, the controller 110 tilts third frame 400 via cylinder 410 such that lower hook 70*b* is fully retracted relative to upper hook 70*a*. Programmable logic controller 110 then actuates hydraulic cylinder 510 to extend the second frame 300 toward the oven door at a "fast" speed. Limit switch 613 sends a signal to the programmable logic controller 110 when the second frame 300 reaches approximately eighty percent of its anticipated travel (about 8 inches from full extension). The programmable logic controller 110 then slows the second frame 300 to a "slow" speed and starts a timer, and when the stop pads 73, 73 of upper hook 70a contact the plane of the back of the door thus stalling forward movement of the extractor, the programmable logic controller receives a signal from the timer at which time third frame 400 is tilted via cylinder 410 such that stop pads 75, 75 of lower door hook 70*b* also contact the plane of the back of the door. Once stop pads 75, 75 make contact, thus stalling further tilting of frame 400, the programmable logic controller 110 actuates hydraulic cylinder 314 which raises third frame 400 and hence door supports 70*a* and 70*b* in low pressure. Proximity switch 610 located on upper door support 70*a* sends a signal to the programmable logic controller 110 that the door is on the supports 70*a* and 70*b* and upward movement of the extractor is thus stalled. At this point the programmable logic controller 110 reading tilt encoder 621 reads and stores in memory the tilt angle $\alpha$. The programmable logic controller 110 actuates hydraulic cylinders 423, 424 to depress the upper and lower oven door compression springs. When the springs are fully compressed, programmable logic controller 110 reading encoder 609 reads and stores in memory the vertical position of door supports 70*a*, 70*b* vertically engaging the door and unlatches the upper and lower levers 427 and 428 by actuating hydraulic cylinders 431, 432. Proximity switches 611 and 612 indicate to the programmable logic controller 110 that the latches are unlatched. Programmable logic controller 110 sends a signal to the hydraulic cylinder 314 to further raise the door supports 70*a* and 70*b* via third frame 400, which raises the door about ½" shearing it away from the oven. The programmable logic controller 110 reads the movement of the vertical travel rotary encoder 609 to determine when this distance has been travelled.

The programmable logic controller 110 actuates hydraulic cylinder 510 which retracts the second frame 300. As the second frame 300 moves from the fully extended position, programmable logic controller 110 causes the door to be positioned into true vertical position by actuating the lean cylinder 233 and the tilt cylinder 410. The retraction first proceeds at a fast speed, and then, when limit switch 614 signals that the 80% retracted position has been reached, shifts to slow speed. Limit switch 615 signals the programmable logic controller 110 that the second frame 300 is at its fully retracted limit. The programmable logic controller 110 actuates hydraulic cylinder 248 to move locking pin 249 to its unlocked position. Upon receiving an unlocked input signal from the proximity switch 618, programmable logic controller 110 actuates hydraulic cylinder 238 which pivots the door extractor 70 90° away from the oven.

Limit switch 617 signals the programmable logic controller 110 that the 90° movement has been reached, and the programmable logic controller 110 actuates hydraulic cylinder 248, moving locking pin 249 into the locked position, thereby locking the door extractor 70.

The extractor 70 maintains the coke oven door in this position enabling the machine 12 on which it is installed to perform other operations, such as coke pushing, jamb cleaning or door cleaning.

Figure 33:
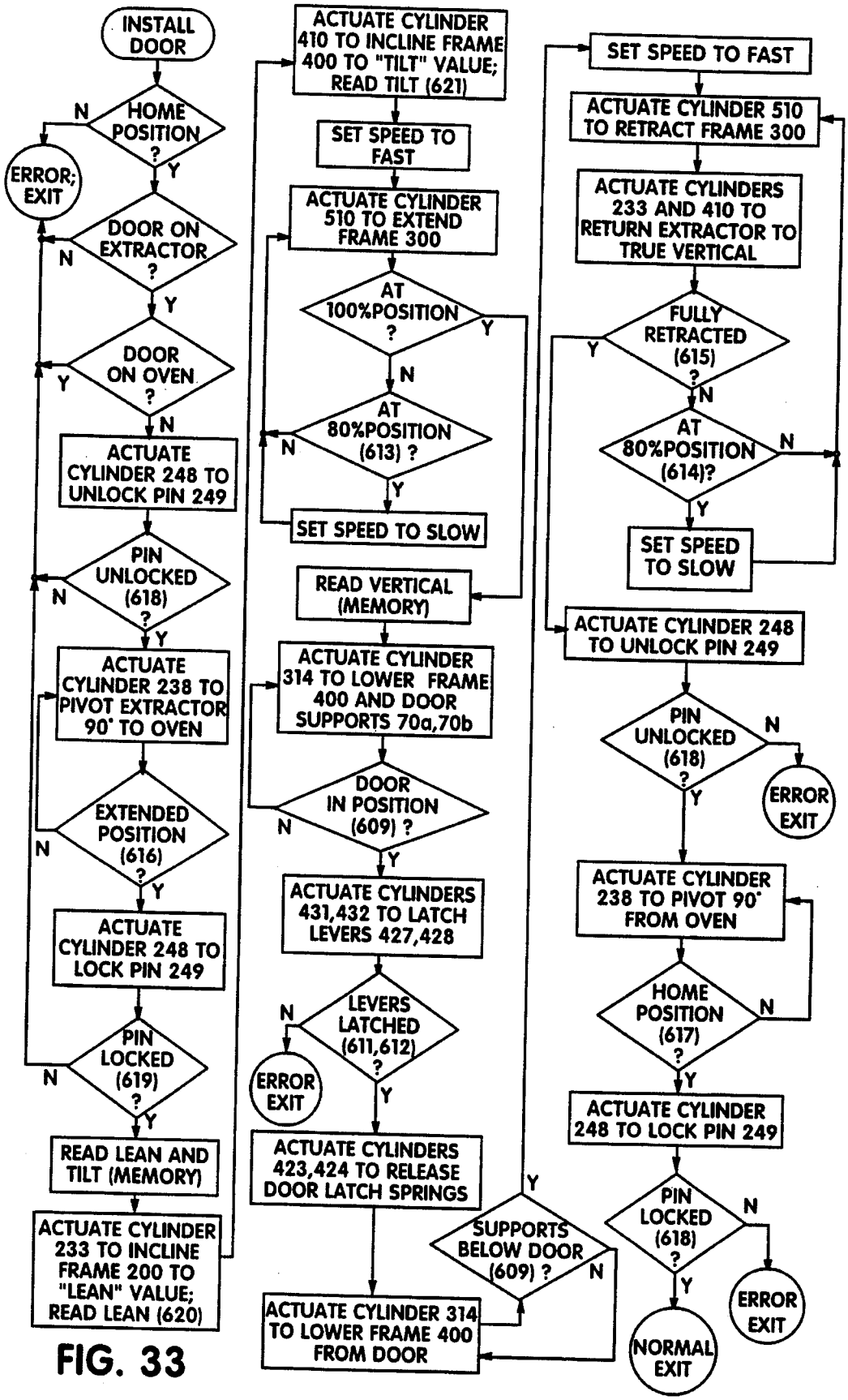
FIG. 33 iS a flow chart illustrating the automatically controlled door installation sequence.

Installation of a door proceeds in a similar manner as door removal, as illustrated in the flowchart of FIG. 33. Prior to the installation of a door, the operator will have moved the car 12 to an on spot position adjacent the selected one of the ovens. Then, the operator will input a button command at the operator I/O interface 112 to initiate a door installation sequence. When this command is given, the controller 110 first checks to verify that the extractor 70 is in the home position, which is a position in which the extractor 70 is adjacent the selected oven and oriented 90° to the oven and locked in position. When the door installation operation is selected, the controller 110 also checks to be sure that there is in fact a door on the extractor supports 70*a*, 70*b*. The condition is checked, for example, by reading the status of switch 610. If the condition is not met, the controller 110 program terminates and displays an error message indicative of the condition.

To automatically reinstall the door, the programmable logic controller 110 actuates hydraulic cylinder 248, moving locking pin 249 to the unlocked position. The proximity switch 618 sends its unlocked input signal to the programmable logic controller 110, which then actuates hydraulic cylinder 238 to pivot extractor 70 90° so that the extractor 70 and hence door faces the oven. Limit switch 616 sends a signal to the programmable logic controller 110 that the extractor 70 is at its limit, and the programmable logic controller 110 relocks the extractor 70 in place by actuating hydraulic cylinder 248 and hence locking pin 249.

Upon receiving a locked input signal from limit switch 619, the programmable logic controller 110, reading the lean and tilt values from memory and signals from the rotary encoder 620 for lean and rotary encoder 621 for tilt, leans and tilts the first frame 200 and third frame 400, respectively, to the pre-programmed position to exactly match the recorded lean and tilt values $\alpha_1$ and $\beta_1$, of the coke oven jamb stored in memory. This will place the door on the oven in the exact orientation it was in when it was removed. Second frame 300 is extended toward the oven at a fast speed as the programmable logic controller actuates hydraulic cylinder 510. Limit switch 613 verifies when second frame 300 reaches approximately eighty percent of its extended limited at which time pressure in cylinder 510 is reduced thus slowing speed of frame 300. Frame 300 continues forward until the door contacts the jamb. The programmable logic controller then reads the original vertical position of the door from memory. The programmable logic controller 110 then actuates hydraulic cylinder 314 which lowers the door supports 70*a* and 70*b* returning the door to its original position. Reading the vertical travel rotary encoder 609 signal, the programmable logic controller 110 notes when the door has returned to its proper position as recalled from memory, and then actuates hydraulic cylinders 431, 432 which operate the latch levers 427, 428 to latch the door. The proximity switches 611, 612 signal the programmable logic controller 110 that the latches 427, 428 are latched. The programmable logic controller 110 now releases the latch springs by actuating hydraulic cylinder 423, 424.

The programmable logic controller 110 then actuates hydraulic cylinder 314 to lower the door supports 70*a*, 70*b* away from the door. The vertical travel rotary encoder 609 signals the programmable logic controller 110 when the extractor is lowered from the door.

The programmable logic controller 110 then actuates hydraulic cylinder 510 to retract the second frame 300 at the fast speed. The programmable logic controller 110 positions the door supports 70*a*, 70*b* into true vertical position by actuating lean hydraulic cylinder 233 and tilt hydraulic cylinder 410. When limit switch 614 is actuated, the speed of frame 300 is slowed. Limit switch 615 signals the programmable logic controller that the second frame 300 is at its fully retracted limit. The programmable logic controller 110 actuates hydraulic cylinder 248 which moves locking pin 249 to the unlocked position. Upon receiving an unlocked input from proximity switch 618, the programmable logic controller 110 actuates hydraulic cylinder 238 which pivots the door extractor 70 90°. The electrical signal from limit 617 signals the programmable logic controller that the pivot limit has been reached, and the programmable logic controller 110 actuates hydraulic cylinder 248 moving locking pin 249 into the locked position, thus securing the door extractor 70.

Those skilled in the art will readily recognize numerous adaptations and modifications which can be made to the coke oven rail car drive control system of the present invention which will result in an improved drive control system, yet all of which will fall within the spirit and scope of the present invention as defined in the claims. For example, in the above description reference has been made to the spotting positioner 120 used in conjunction with the pusher machine 12, but of course those skilled in the art will readily recognize that the positioner 120 could as well be, and would preferably be, used in conjunction with the door machine 14, as well as the "charge" car which rides atop the battery and which charges the ovens. In addition, the spotting positioner 120 could be as well mounted on an idler axle rather than on a drive axle as illustrated. Further, while the invention has been described as storing the lean values long term and the tilt values temporarily, those skilled in the art will recognize that both lean and tilt values could be stored long term, or temporarily, as could the vertical values, and that either scheme is contemplated as being within the scope of the invention. Accordingly, the invention is to be limited only by the scope of the following claims and their equivalents.

What is claimed is:

1. A combination comprising:

a car adapted to roll on rails adjacent to and along the length of a coke oven battery having a plurality of coke ovens, each oven of which includes a coke oven door jamb and a coke oven door removably securable to the coke oven door jamb; and a coke oven door extractor mounted on said car for removing and replacing a coke oven door from and onto its respective coke oven door jamb, said extractor including a pair of door engaging supports for engaging and supporting the door, each said support being movable relative to a plane parallel to and including the door jamb in an amount different from that of the other said support;

whereby said door extractor can compensate for front-to-back tilting of the coke oven door jamb due to thermal distortion of the battery;

each said support being additionally movable relative to a door jamb height axis of symmetry in an amount different from that of the other said support;

whereby said door extractor can also compensate for side-to-side leaning of the coke oven door jamb due to thermal distortion of the battery.

2. The combination of claim 1 further comprising:

a sensor for determining the relative position of the car with respect to a selected oven in the battery;

a first drive for effecting gross movement of said car along the rails and gross positioning of said car relative to the selected oven on the basis of a first position determined by said sensor of said car relative to the selected oven; and a second automatically controlled drive for effecting fine movement of said car along the rails and fine positioning of said car relative to the selected oven on the basis of a second position determined by said sensor of the car relative to the selected oven.

3. A combination comprising:

a car adapted to roll on rails adjacent to and along the length of a coke oven battery having a plurality of coke ovens, each oven of which includes a coke oven door jamb and a coke oven door removably securable to the coke oven door jamb;

a coke oven door extractor mounted on said car for removing and replacing a coke oven door from and onto its respective coke oven door jamb, said extractor including a pair of door engaging supports for engaging and supporting the door, and means for moving each said support to compensate for front-to-back tilting of the coke oven door jamb due to thermal distortion of the battery in amount different from that of the other said support; and means for moving each said support to also compensate for side-to-side leaning of the coke oven door jamb due to thermal distortion of the battery in an amount different from that of the other said support.

4. The combination of claim 3 further comprising:

a sensor for determining the relative position of the car with respect to a selected oven in the battery;

a first drive for effecting gross movement of said car along the rails and gross positioning of said car relative to the selected oven on the basis of a first position determined by said sensor of said car relative to the selected oven; and a second automatically controlled drive for effecting fine movement of said car along the rails and fine positioning of said car relative to the selected oven on the basis of a second position determined by said sensor of the car relative to the selected oven.

5. A coke oven door extractor for removing and replacing a coke oven door from and onto its respective coke oven door jamb comprising:

a frame;

a pair of door engaging supports mounted on said frame, said supports for engaging and supporting a coke oven door;

means for moving each said support relative to a plane parallel to and including a door jamb in an amount different from that of the other said support;

whereby said door extractor can compensate for front-to-back tilting of the coke oven door jamb due to thermal distortion of the battery; and means for moving each said support relative to a door jamb height axis of symmetry in an amount different from that of the other said support;

whereby said door extractor can also compensate for side-to-side leaning of the coke oven door jamb due to thermal distortion of the battery.

6. A coke oven door extractor for removing and replacing a coke oven door from and its respective coke oven door jamb comprising:

a first frame adapted to be mounted on a coke oven rail car;

a second frame movably mounted on said first frame;

a third frame movably mounted on said second frame, said third frame including a pair of door engaging supports for engaging and supporting a coke oven door;

means for moving said third frame relative to said second frame to effect movement of each said support relative to a plane parallel to and including the door jamb in an amount different from that of the other said support;

whereby said door extractor can compensate for front-to-back tilting of the coke oven door jamb due to thermal distortion of the jamb; and means for moving said first frame relative to the car to effect movement of each said support relative to a door jamb height axis of symmetry in an amount different from that of the other said support;

whereby said door extractor can also compensate for side-to-side learning of the coke oven door jamb due to thermal distortion of the jamb.

7. A coke oven door extractor for removing and replacing a coke oven door from and onto its respective coke oven door lamb comprising:

a first frame adapted to be mounted on a coke oven rail car;

a second frame movably mounted on said first frame;

a third frame movably mounted on said second frame, said third frame including a pair of door engaging supports for engaging and supporting a coke oven door;

means for moving said third frame relative to said second frame to effect movement of said supports in individually differing amounts relative to a plane parallel to and including the door jamb;

whereby said door extractor can compensate for front-to-back tilting of the coke oven door lamb due to thermal distortion of the jamb;

wherein said means for moving said third frame relative to said second frame comprises:

a pivot connection pivotally connecting an upper end of said third frame to said second frame; and a hydraulic cylinder operably connected between a lower end of said third frame and said second frame;

whereby extending and retracting said cylinder pivots said third frame and hence said door supports relative to said second frame about said pivot connection.

8. A coke oven door extractor for removing and replacing a coke oven door from and onto its respective coke oven door lamb comprising:

a first frame adapted to be mounted on a coke oven rail car;

a second frame movably mounted on said first frame;

a third frame movably mounted on said second frame, said third frame including a pair of door engaging supports for engaging and supporting a coke oven door;

means for moving said third frame relative to said second frame to effect movement of said supports in individually differing amounts relative to a plane parallel to and including the door jamb;

whereby said door extractor can compensate for front-to-back tilting of the coke oven door jamb due to thermal distortion of the jamb; and means for moving said first frame relative to the car to effect movement of said supports in individually differing amounts relative to a door lamb height axis of symmetry;

whereby said door extractor can also compensate for side-to-side leaning of the coke oven door jamb due to thermal distortion of the jamb;

wherein said means for moving said first frame relative to the car comprises:

a pivot connection pivotally connecting a lower end of said first frame to the car; and a hydraulic cylinder operably connected between an upper end of said first frame and the car;

whereby extending and retracting said cylinder pivots said first frame and hence said door supports relative to the car about said pivot connection.

9. A coke oven door extractor for removing and replacing a coke oven door from and onto its respective coke oven door jamb comprising:

a first frame adapted to be mounted on a coke oven rail car;

a second frame movably mounted on said first frame;

means for effecting relative horizontal movement between said first and second frames;

a third frame movably mounted on said second frame, said third frame including a pair of door engaging supports for engaging and supporting a coke oven door;

means for effecting relative vertical movement between said second and third frames;

whereby said second frame and hence said door supports can be extended forwardly to engage a coke oven door, and said third frame and hence said door supports can be raised upwardly to remove the door from its door jamb;

means for moving each said support relative to a plane parallel to and including the door jamb in an amount different from that of the other said support;

whereby said door extractor can compensate for front-to-back tilting of the coke oven jamb due to thermal distortion of the jamb; and means for moving each said support relative to door jamb height axis of symmetry in an amount different from that of the other said support;

whereby said door extractor can compensate for side-to-side leaning of the coke oven jamb due to normal distortion at the jamb.

10. The coke oven door extractor of claim 9 wherein said means for effecting relative vertical movement between said second and third frames comprises:

rollers mounted on said third frame;

slots in said second frame, said rollers riding in said slots; and a hydraulic cylinder connected between said second and third frames;

whereby extending and retracting said cylinder rolls said third frame upwardly and downwardly relative to said second frame.

11. A coke oven door extractor for removing and replacing a coke oven door from and onto its respective coke oven door jamb comprising:

a first frame adapted to be mounted on a coke oven rail car;

a second frame movably mounted on said first frame;

means for effecting relative horizontal movement between said first and second frames;

a third frame movably mounted on said second frame, said third frame including a pair of door engaging supports for engaging and supporting a coke oven door; and means for effecting relative vertical movement between said second and third frames;

whereby said second frame and hence said door supports can be extended forwardly to engage a coke oven door, and said third frame and hence said door supports can be raised upwardly to remove the door from its door jambs;

wherein said means for effecting relative horizontal movement between said first and second frames comprises:

a fourth frame movably mounted on said first frame;

means for effecting relative vertical movement between said first and fourth frames; and linkage connecting said fourth and second frames;

whereby when said relative vertical movement means moves said fourth frame relative to said first frame in a first vertical direction said linkage moves said second frame relative to said first frame in a first horizontal direction, and when said relative vertical movement means moves said fourth frame relative to said first frame in a second vertical direction said linkage moves said second frame relative to said first frame in a second horizontal direction.

12. The coke oven door extractor of claim 11 wherein said means for effecting relative horizontal movement between said first and second frames further comprises:

rollers mounted on said second frame; and horizontally oriented channels mounted on said first frame, said rollers riding in said channels.

13. The coke oven door extractor of claim 11 wherein said means for effecting relative vertical movement between said first and fourth frames comprises:

rollers mounted on said fourth frame;

vertically oriented channels mounted on said first frame, said rollers riding in said channels; and a hydraulic cylinder connected between said first and fourth frames;

whereby extending and retracting said cylinder rolls said fourth frame upwardly and downwardly relative to said first frame.

14. A combination comprising:

a car adapted to roll on rails adjacent to and along the length of a coke oven battery having a plurality of coke ovens, each oven of which includes a coke oven door jamb and a coke oven door removably securable to the coke oven door jamb;

a sensor for determining the relative position of said car with respect to a selected oven in the battery;

a coke oven door extractor mounted on said car for removing and replacing a coke oven door from and onto its respective coke oven door jamb, said extractor including a pair of door engaging supports for engaging and supporting the door, said supports being movable in individually differing amounts relative to at least one of a plane parallel to and including the door jamb and a door jamb height axis of symmetry; and an automatic controller for automatically controlling movements of said door supports in said individually differing amounts equal to at least one of an angle of front-to-back tilting by which the plane parallel to and including the door jamb deviates from vertical and an angle of side-to-side leaning by which the door jamb height axis deviates from vertical in response to a position determined by said sensor of said car relative to the selected oven;

whereby said door extractor can automatically compensate for at least one of front-to-back tilting and side-to-side leaning of the coke oven door jamb due to thermal distortion of the battery.

15. The combination of claim 14 wherein:

said supports are movable in individually differing amounts relative to the plane parallel to and including the door jamb;

whereby said door extractor can compensate for front-to-back tilting of the coke oven door jamb due to thermal distortion of the battery.

16. The combination of claim 14 wherein:

said supports are movable in individually differing amounts relative to the door jamb height axis of symmetry;

whereby said door extractor can compensate for side-to-side leaning of the coke oven door jamb due to thermal distortion of the battery.

17. The combination of claim 14 wherein:

said supports are movable in individually differing amounts relative to both the plane parallel to and including the door jamb and the door jamb height axis of symmetry;

whereby said door extractor can compensate for both front-to-back tilting and side-to-side leaning of the oven door jamb due to thermal distortion of the battery.

18. The combination of claim 14 further comprising:

a first drive for effecting gross movement of said car along the rails and gross positioning of said car relative to the selected oven on the basis of a first position determined by said sensor of said car relative to the selected oven; and a second automatically controlled drive for effecting fine movement of said car along the rails and fine positioning of said car relative to the selected oven on the basis of a second position determined by said sensor of the car relative to the selected oven.

19. The combination of claim 14 wherein said door extractor further comprises:

a first frame adapted to be mounted on said coke oven rail car;

a second frame movably mounted on said first frame;

a third frame movably mounted on said second frame, said third frame including said door engaging supports; and means for moving said third frame relative to said second frame to effect movement of said supports in said individually differing amounts relative to said plane parallel to and including the door jamb;

whereby said door extractor can compensate for said front-to-back tilting of the coke oven door jamb due to thermal distortion of the battery.

20. The combination of claim 19 wherein said door extractor further comprises:

means for moving said first frame relative to said car to effect movement of said supports in said individually differing amounts relative to a door jamb height axis of symmetry;

whereby said extractor can additionally compensate for said side-to-side leaning of the coke oven door jamb due to thermal distortion of the battery.

21. The combination of claim 14 wherein said door extractor further comprises:

a first frame adapted to be mounted on said coke oven rail car;

a second frame movably mounted on said first frame;

means for effecting relative horizontal movement between said first and second frames;

a third frame movably mounted on said second frame, said third frame including said door engaging supports; and means for effecting relative vertical movement between said second and third frames;

whereby said second frame and hence said door supports can be extended forwardly to engage a coke oven door, and said third frame and hence said door supports can be raised upwardly to remove the door from its door jamb.

22. The combination of claim 21 wherein said door extractor further comprises:

means for moving said supports in said individually differing amounts relative to said plane parallel to and including the door jamb and said door jamb height axis of symmetry;

whereby said door extractor can compensate for both said front-to-back tilting and said side-to-side leaning of the coke oven jamb due to thermal distortion of the jamb.

23. The combination of claim 21 wherein said means for effecting relative vertical movement between said second and third frames comprises:

rollers mounted on said third frame;

slots in said second frame, said rollers riding in said slots; and a hydraulic cylinder connected between said second and third frames;

whereby extending and retracting said cylinder rolls said third frame upwardly and downwardly relative to said second frame.

24. A combination comprising:

a car adapted to roll on rails adjacent to and along the length of a coke oven battery having a plurality of coke ovens, each oven of which includes a coke oven door jamb and a coke oven door removably securable to the coke oven door jamb;

a sensor for determining the relative position of said car with respect to a selected oven in the battery;

a coke oven door extractor mounted on said car for removing and replacing a coke oven door from and onto its respective coke oven door jamb, said extractor including a pair of door engaging supports for engaging and supporting the door, said supports being movable in individually differing amounts relative to at least one of a plane parallel to and including the door jamb and a door jamb height axis of symmetry;

an automatic controller for automatically controlling movements of said door supports in response to a position determined by said sensor of said car relative to the selected oven;

whereby said door extractor can automatically compensate for at least one of front-to-back tilting and side-to-side leaning of the coke oven door jamb due to thermal distortion of the battery;

a first frame adapted to be mounted on said coke oven rail car;

a second frame movably mounted on said first frame;

a third frame movably mounted on said second frame, said third frame including said door engaging supports; and means for moving said third frame relative to said second frame to effect movement of said supports in said individually differing amounts relative to said plane parallel to and including the door jamb;

whereby said door extractor can compensate for said front-to-back tilting of the coke oven door jamb due to thermal distortion of the battery;

wherein said means for moving said third frame relative to said second frame comprises:

a pivot connection pivotally connecting an upper end of said third frame to said second frame; and a hydraulic cylinder operably connected between a lower end of said third frame and said second frame;

whereby extending and retracting said cylinder pivots said third frame and hence said door supports relative to said second frame about said pivot connection.

25. A combination comprising:

a car adapted to roll on rails adjacent to and along the length of a coke oven battery having a plurality of coke ovens, each oven of which includes a coke oven door jamb and a coke oven door removably securable to the coke oven door jamb;

a sensor for determining the relative position of said car with respect to a selected oven in the battery;

a coke oven door extractor mounted on said car for removing and replacing a coke oven door from and onto its respective coke oven door jamb, said extractor including a pair of door engaging supports for engaging and supporting the door, said supports being movable in individually differing amounts relative to at least one of a plane parallel to and including the door jamb and a door jamb height axis of symmetry;

an automatic controller for automatically controlling movements of said door supports in response to a position determined by said sensor of said car relative to the selected oven;

whereby said door extractor can automatically compensate for at least one of front-to-back tilting and side-to-side leaning of the coke oven door jamb due to thermal distortion of the battery;

a first frame adapted to be mounted on said coke oven rail car;

a second frame movably mounted on said first frame;

a third frame movably mounted on said second frame, said third frame including said door engaging supports;

means for moving said third frame relative to said second frame to effect movement of said supports in said individually differing amounts relative to said plane parallel to and including the door jamb;

whereby said door extractor can compensate for said front-to-back tilting of the coke oven door jamb due to thermal distortion of the battery; and means for moving said first frame relative to said car to effect movement of said supports in said individually differing amounts relative to a door jamb height axis of symmetry;

whereby said extractor can additionally compensate for said side-to-side leaning of the coke oven door jamb due to thermal distortion of the battery;

wherein said means for moving said first frame relative to said car comprises:

a pivot connection pivotally connecting a lower end of said first frame to said car; and a hydraulic cylinder operably connected between an upper end of said first frame and said car;

whereby extending and retracting said cylinder pivots said first frame and hence said door supports relative to said car about said pivot connection.

26. A combination comprising:

a car adapted to roll on rails adjacent to and along the length of a coke oven battery having a plurality of coke ovens, each oven of which includes a coke oven door jamb and a coke oven door removably securable to the coke oven door lamb;

a sensor for determining the relative position of said car with respect to a selected oven in the battery;

a coke oven door extractor mounted on said car for removing and replacing a coke oven door from and onto its respective coke oven door jamb, said extractor including a pair of door engaging supports for engaging and supporting the door, said supports being movable in individually differing amounts relative to at least one of a plane parallel to and including the door jamb and a door jamb height axis of symmetry;

an automatic controller for automatically controlling movements of said door supports in response to a position determined by said sensor of said car relative to the selected oven;

whereby said door extractor can automatically compensate for at least one of front-to-back tilting and side-to-side leaning of the coke oven door jamb due to thermal distortion of the battery;

a first frame adapted to be mounted on said coke oven rail car;

a second frame movably mounted on said first frame;

means for effecting relative horizontal movement between said first and second frames;

a third frame movably mounted on said second frame, said third frame including said door engaging supports; and means for effecting relative vertical movement between said second and third frames;

whereby said second frame and hence said door supports can be extended forwardly to engage a coke oven door, and said third frame and hence said door supports can be raised upwardly to remove the door from its door jamb;

wherein said means for effecting relative horizontal movement between said first and second frames comprises:

a fourth frame movably mounted on said first frame;

means for effecting relative vertical movement between said first and fourth frames; and linkage connecting said fourth and second frames;

whereby when said relative vertical movement means moves said fourth frame relative to said first frame in a first vertical direction said linkage moves said second frame relative to said first frame in a first horizontal direction, and when said relative vertical movement means moves said fourth frame relative to said first frame in a second vertical direction said linkage moves said second frame relative to said first frame in a second horizontal direction.

27. The combination of claim 26 wherein said means for effecting relative horizontal movement between said first and second frames further comprises:

rollers mounted on said second frame; and horizontally oriented channels mounted on said first frame, said rollers riding in said channels.

28. The combination of claim 26 wherein said means for effecting relative vertical movement between said first and fourth frames comprises:

rollers mounted on said fourth frame;

vertically oriented channels mounted on said first frame, said rollers riding in said channels; and a hydraulic cylinder connected between said first and fourth frames;

whereby extending and retracting said cylinder rolls said fourth frame upwardly and downwardly relative to said first frame.

29. A combination comprising:

a car adapted to roll on rails adjacent to and along the length of a coke oven battery having a plurality of coke ovens, each oven of which includes a coke oven door jamb and a coke oven door removably securable to the coke oven door jamb;

a coke oven door extractor mounted on said car for removing and replacing a coke oven door from and onto its respective coke oven door jamb, said extractor including a pair of door engaging supports for engaging and supporting the door, said supports being movable in individually differing amounts relative to at least one of a plane parallel to and including the door jamb and a door jamb height axis of symmetry; and an automatic controller for automatically controlling movements of said supports in said individually differing amounts equal to at least one of an angle of front-to-back tilting by which the plane parallel to and including the door jamb deviates from vertical and an angle of side-to-side leaning by which the door jamb height axis of symmetry deviates from vertical;

whereby said door extractor can automatically compensate for at least one of front-to-back tilting and side-to-side leaning of the coke oven door jamb due to thermal distortion of the battery.

30. The combination of claim 29 wherein:

said supports are movable in individually differing amounts relative to the plane parallel to and including the door jamb;

whereby said door extractor can compensate for front-to-back tilting of the coke oven door jamb due to thermal distortion of the battery.

31. The combination of claim 29 wherein:

said supports are movable in individually differing amounts relative to the door jamb height axis of symmetry;

whereby said door extractor can compensate for side-to-side leaning of the coke oven door jamb due to thermal distortion of the battery.

32. The combination of claim 29 wherein:

said supports are movable in individually differing amounts relative to both the plane parallel to and including the door jamb and the door jamb height axis of symmetry;

whereby said door extractor can compensate for both front-to-back tilting and side-to-side leaning of the oven door jamb due to thermal distortion of the battery.

33. A combination comprising:

a car adapted to roll on rails adjacent to and along the length of a coke oven battery having a plurality of coke ovens, each one of which includes a coke oven door jamb and a coke oven door removably securable to the coke oven door jamb;

a coke oven door extractor mounted on said car for removing and replacing a coke oven door from and onto its respective coke oven door jamb, said extractor including a pair of door engaging supports for engaging and supporting a door, said supports being movable vertically relative to a coke oven door;

a memory in which to store and from which to recall the vertical position of each said oven door; and an automatic controller for automatically controlling movement of said supports vertically in response to the vertical position recalled from said memory corresponding to a selected one of said plurality of oven doors;

whereby said door extractor can automatically compensate for variations in relative vertical height between said door extractor and a plurality of coke oven doors.

34. A coke oven door extractor for removing and replacing a coke oven door from and onto its respective coke oven door jamb comprising:

a pair of door engaging supports for engaging and supporting a coke oven door;

means for translating said supports generally horizontally relative to a coke oven door;

means for translating said supports generally vertically relative to a coke oven door;

means for rotating said supports front-to-back about a generally horizontal axis relative to a coke oven door; and means for rotating said supports side-to-side about a generally horizontal axis relative to a coke oven door.

35. A method of reducing damage inflicted upon a coke oven door jamb and coke oven door, during removal of the door from the jamb and reinstallation of the door onto the jamb, by a coke oven door extractor having a pair of door engaging supports for engaging and supporting a door, comprising the steps of:

determining the front-to-back tilting orientation of the door;

storing in a memory the orientation;

removing the door from the jamb;

recalling from memory the orientation;

automatically moving the supports to the orientation; and reinstalling the door onto the jamb.

36. A method of reducing damage inflicted upon a coke oven door, during removal of the door from the jab and reinstallation of the door onto the jamb, by a coke oven door extractor having a pair of door engaging supports, for engaging and supporting a door, comprising the steps of:

determining the side-to-side leaning orientation of the door;

storing in a memory the orientation;

removing the door from the jamb;

recalling from memory the orientation;

automatically moving the supports to the orientation; and reinstalling the door onto the jamb.

37. A method of reducing damage inflicted upon a coke oven door jamb and coke oven door, during removal of the door from the jamb and reinstallation of the door onto the jamb, by a coke oven door extractor having a pair of door engaging supports for engaging and supporting a door, comprising the steps of:

determining the vertical orientation of the door;

storing in a memory the orientation;

removing the door from the jamb;

recalling from memory the orientation;

automatically moving the door extractor to the orientation; and reinstalling the door onto the jamb.

38. Apparatus for reducing damage inflicted upon a coke oven door jamb and coke oven door during removal of the door from the jamb and reinstallation of the door onto the jamb comprising:

a coke oven door extractor having a pair of door engaging supports for engaging and supporting a door during removal from and reinstallation onto the jamb;

means for determining the front-to-back tilting orientation of the door;

memory means in which to store and from which to recall the orientation; and means for automatically moving said supports to the orientation.

39. Apparatus for reducing damage inflicted upon a coke oven door jamb and coke oven door during removal of the door from the jamb and reinstallation of the door onto the jamb comprising:

a coke oven door extractor having a pair of door engaging supports for engaging and supporting a door during removal from and reinstallation onto the jamb;

means for determining the side-to-side leaning orientation of the door;

memory means in which to store and from which to recall the orientation; and means for automatically moving said supports to the orientation.

40. Apparatus for reducing damage inflicted upon a coke oven door jamb and a coke oven door during removal of the door from the jamb and reinstallation of the door onto the jamb comprising:

a coke oven door extractor having a pair of door engaging supports for engaging and supporting a door during removal from and reinstallation onto the jamb;

means for determining the vertical orientation of the door;

memory means in which to store and from which to recall the orientation; and means for automatically moving said supports to the orientation.

* * * * *

UNITED STATES PATENT AND TRADEMARK OFFICE

CERTIFICATE OF CORRECTION

PATENT NO. : 5,564,340

DATED : October 15, 1996

INVENTOR(S) : Billy Carr Baird, Robert Harley Higginson and Roger Allyn Kares

It is certified that error appears in the above-indentified patent and that said Letters Patent is hereby corrected as shown below:

Column 24, line 52 , change "learning" to -- leaning --.

Column 24, line 56, change "lamb" to -- jamb --.

Column 25, line 2, change "lamb" to -- jamb --.

Column 25, line 15, change "lamb" to -- jamb --.

Column 25, line 32, change "lamb" to -- jamb --.

Signed and Sealed this

Seventh Day of October, 1997

*Attest:*

*Attesting Officer*

Bruce Lehman

BRUCE LEHMAN

*Commissioner of Patents and Trademarks*